US012227894B2

(12) United States Patent
Roh et al.

(10) Patent No.: US 12,227,894 B2
(45) Date of Patent: Feb. 18, 2025

(54) CLOTHING PROCESSING APPARATUS

(71) Applicant: LG Electronics Inc., Seoul (KR)

(72) Inventors: Jeongjoon Roh, Seoul (KR); Jihyun Yoon, Seoul (KR); Ayeong Lee, Seoul (KR); Taehee Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 736 days.

(21) Appl. No.: 17/310,880

(22) PCT Filed: Feb. 28, 2020

(86) PCT No.: PCT/KR2020/002910

§ 371 (c)(1),
(2) Date: Aug. 27, 2021

(87) PCT Pub. No.: WO2020/175963

PCT Pub. Date: Sep. 3, 2020

(65) Prior Publication Data

US 2022/0145525 A1 May 12, 2022

(30) Foreign Application Priority Data

Feb. 28, 2019 (KR) ..... 10-2019-0024363

(51) Int. Cl.
*D06F 73/02* (2006.01)
*D06L 1/20* (2006.01)

(52) U.S. Cl.
CPC ..... *D06F 73/02* (2013.01); *D06L 1/20* (2013.01)

(58) Field of Classification Search
CPC ..... D06F 73/02; D06L 1/20
See application file for complete search history.

(56) References Cited

U.S. PATENT DOCUMENTS 4,645,101 A 2/1987 Müller
9,765,474 B1 9/2017 Bergman
(Continued)

FOREIGN PATENT DOCUMENTS

CN 108166209 A 6/2018
CN 108611828 A 10/2018
(Continued)

OTHER PUBLICATIONS

International Search Report dated Jun. 10, 2020, in related International Patent Application No. PCT/KR2020/002910 (4 pages).

*Primary Examiner* — Joseph L. Perrin
(74) *Attorney, Agent, or Firm* — Birch, Stewart, Kolasch & Birch, LLP

(57) ABSTRACT

A clothing processing apparatus according to an embodiment of the present disclosure may include a cabinet having a receiving space formed therein, in which clothing is received, a holder configured to be located in the receiving space to hold a clothing supporter configured to support the clothing, a steamer configured to spray steam toward the clothing while moving inside the receiving space in the vertical direction, an elevating motor configured to provide an elevating power of the steamer, a spreader configured to move in a left and right direction to move into a body of the clothing and apply a mechanical force so as to spread the body of the clothing, and a spreader moving motor configured to move the spreader in the left and right direction.

12 Claims, 17 Drawing Sheets

(56) References Cited

U.S. PATENT DOCUMENTS

| | | | | |
|---|---|---|---|---|
| 2010/0282785 | A1 | 11/2010 | Roselle et al. | |
| 2012/0317729 | A1 | 12/2012 | Song et al. | |
| 2018/0002860 | A1* | 1/2018 | Song | D06F 58/10 |
| 2019/0017219 | A1 | 1/2019 | Song et al. | |
| 2019/0368117 | A1* | 12/2019 | Kim | D06F 58/10 |
| 2020/0040504 | A1 | 2/2020 | Rochford et al. | |

FOREIGN PATENT DOCUMENTS

| | | | |
|---|---|---|---|
| DE | 91 06 300 | U1 | 7/1991 |
| EP | 0 636 735 | A1 | 2/1995 |
| EP | 0 926 293 | A1 | 6/1999 |
| JP | 53-45436 | B2 | 12/1978 |
| JP | H07-163797 | A | 6/1995 |
| JP | 2012-524642 | A | 10/2012 |
| KR | 10-2007-0109319 | A | 11/2007 |
| KR | 10-2009-0059358 | A | 6/2009 |
| KR | 10-2010-0067780 | A | 6/2010 |
| KR | 10-2010-0100501 | A | 9/2010 |
| KR | 10-2015-0078400 | A | 7/2015 |
| KR | 10-2017-0037922 | A | 4/2017 |
| KR | 10-2018-0037459 | A | 4/2018 |

* cited by examiner

CLOTHING PROCESSING APPARATUS

TECHNICAL FIELD

The present disclosure relates to a clothing processing apparatus, and more particularly, to a clothing processing apparatus for refreshing clothing.

BACKGROUND

In general, a washing machine is widely used as a device for washing articles made of fabrics such as clothing or bedding, and the washing machine washes the laundry through friction between the laundry water and the laundry received in a water tank, so that separate dehydration, drying process, and the like were additionally required.

Recently, as a device for processing or managing clothing more conveniently than the conventional washing machine, there are clothing processing apparatus are used, which has functions such as removing wrinkles from clothing or removing dust or odors from clothing without a separate washing process through washing water.

In Prior Document 1 (KR 10-2010-0067780A) of the prior art, a method of filling the entire inner portion of the device with steam is employed. However, there is a problem that a mechanical force is not applied to the clothing only by a method of filling the steam into the device so that the clothing is not spread taut.

In Prior Document 2 (KR 10-2010-0100501A), a press method is employed. However, since this method requires tensile force in several directions, the volume of the device is increased and the cost is high so that this method cannot be used for home use.

In Prior Document 3 (KR 10-2015-0078400A), a method of spraying steam close to clothing is employed. However, as in Prior Document 1, the mechanical force is not applied to the clothing, so that the clothing is not spread taut. In addition, since the clothing has to be placed on a floor frame, there is a risk that the clothing may be ironed with wrinkles occurring.

In Prior Document 4 (KR 10-2018-0037459A), a scanning method in which steam is sprayed while moving along the surface of clothing to remove wrinkles of the clothing is employed. However, when the top is hung on a hanger, the arm portion overlaps the body portion and maintains a state of being wrinkled. In this state, there is a problem that more severe and strong wrinkles are obtained when the clothing processing of the arm portion is performed.

SUMMARY

Technical Problem

An object to be solved by the present disclosure is to provide a clothing processing apparatus that minimizes wrinkles of clothing and refreshes the clothing.

Another object to be solved by the present disclosure is to provide a compact clothing processing apparatus.

Technical Solution

The clothing processing apparatus according to an embodiment of the present disclosure may spray steam while elevating the steamer in the vertical direction in a state where the body of the clothing is tensioned tautly by the spreader. Accordingly, the body of the clothing is not wrinkled and can be effectively refreshed.

In more detail, a clothing processing apparatus according to an embodiment of the present disclosure may include a cabinet having a receiving space formed therein, in which clothing is received, a holder configured to be located in the receiving space to hold a clothing supporter configured to support the clothing; a steamer configured to spray steam toward the clothing while moving inside the receiving space in the vertical direction, an elevating motor configured to provide an elevating power of the steamer, a spreader configured to move in a left and right direction to move into a body of the clothing and apply a mechanical force so as to spread the body of the clothing, and a spreader moving motor configured to move the spreader in the left and right direction.

The spreader may include a moving body configured to move in the left and right direction by the spreader moving motor, and a tension part configured to protrude upward from the moving body and to move into the body of the clothing.

The tension part may have a multi-stage structure in which the length is variable.

The clothing processing apparatus may further include a spreader guide rail configured to be disposed on an inner bottom surface of the cabinet long in the left and right direction to guide the movement of the moving body in the left and right direction.

The moving body may include a main body to which the tension part is connected, and a guide block located below the main body and having a guide groove into which the spreader guide rail is fitted formed therein.

The clothing processing apparatus of claim may further include a rotation pulley configured to be connected to the spreader moving motor, a support pulley configured to be spaced apart from the rotation pulley, and a belt configured to be connected to the rotation pulley and the support pulley to form a closed curve. A belt holder holding the belt may be provided in the spreader.

The clothing processing apparatus may further include a separator configured to move in the left and right direction and to move between the body and arms of the clothing to separate the body and arms of the clothing, and a separator moving motor configured to move the separator in the left and right direction.

The clothing processing apparatus may further include a spreader guide rail configured to be disposed long in the left and right direction on the inner bottom surface of the cabinet to guide movement of the spreader in the left and right direction, and a separator guide rail configured to be spaced from the spreader guide rail in a front and rear direction, to be disposed long in a direction parallel to the spreader guide rail, and to guide the movement of the separator in the left and right direction.

A length of the spreader guide rail may be shorter than a length of the separator guide rail.

The clothing processing apparatus may further include a blower configured to be disposed in the inner portion of the cabinet and to blow air into the body of the clothing from a lower side of the clothing.

The blower may include a blowing fan, an air guide configured to guide the air blown by the blowing fan into the body of the clothing, and a blowing fan support part configured to be installed on an inner bottom surface of the cabinet and to support the blowing fan.

The clothing processing apparatus may further include a spreader guide rail configured to be disposed long in the left and right direction on an inner bottom surface of the cabinet, to pass through an inner portion of the blower fan support, and to guide the movement of the spreader in the left and right direction.

A pair of the spreaders positioned opposite to each other with respect to the blower may be provided.

A method for controlling a clothing processing apparatus according to an embodiment of the present disclosure may include a body alignment step of moving a pair of separators away from each other so that the body of the clothing is separated from both arms, a blowing step of turning on a blowing fan located under the clothes to blow air into the body of the clothes, an insertion step of extending the length of the pair of spreaders and inserting the pair of spreaders into the body of the clothing in a state where the blowing fan is turned on, a tension step in which the pair of spreaders move in a direction away from each other to tension the body of the clothing, and a body scanning step in which a steamer moves in a vertical direction and sprays steam toward clothes.

The method for controlling a clothing processing apparatus may further include a first arm alignment step of moving the pair of separators in one direction so that one arm of the clothing is separated from the body of the clothing to droop downward, a first arm scanning step in which the steamer elevates in the vertical direction and sprays steam in a state where the one arm is separated from the body and droops downward, a second arm alignment step of moving the pair of separators in other directions so that the other arm of the clothing is separated from the body and droops downward, and a second arm scanning step in which the steamer elevates in the vertical direction and sprays steam in a state where the other arm is separated from the body and droops downward.

The body alignment step may be performed after the second arm scanning step.

DETAILED DESCRIPTION

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the disclosure may be practiced. These embodiments are described in sufficient detail to enable those skilled in the art to practice the disclosure, and it is understood that other embodiments may be utilized and that logical structural, mechanical, electrical, and chemical changes may be made without departing from the spirit or scope of the disclosure. To avoid detail not necessary to enable those skilled in the art to practice the disclosure, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present disclosure. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Hereinafter, specific embodiments of the present disclosure will be described in detail with drawings.

In the present specification, a refresher for refreshing clothing as a clothing processing apparatus is described, but the present disclosure is not limited thereto and the inventive concept may be applied to other devices that may include a heat pump to be described later.

Here, the term "refresh" may mean a process of performing removing wrinkles, deodorizing, sanitizing, preventing static electricity, warming of clothing or the like by supplying air, heated air, or the like to clothing or providing water, mist, steam, or the like (hereinafter collectively referred to as 'steam' for convenience) to clothing. In addition, the clothing referred to in this specification includes not only clothing and apparel, but also objects that can be worn by a person, such as shoes, socks, gloves, hats, and scarves, as well as objects that can be used by a person such as dolls, towels, and blankets, and includes all objects that can perform washing.

Figure 1:
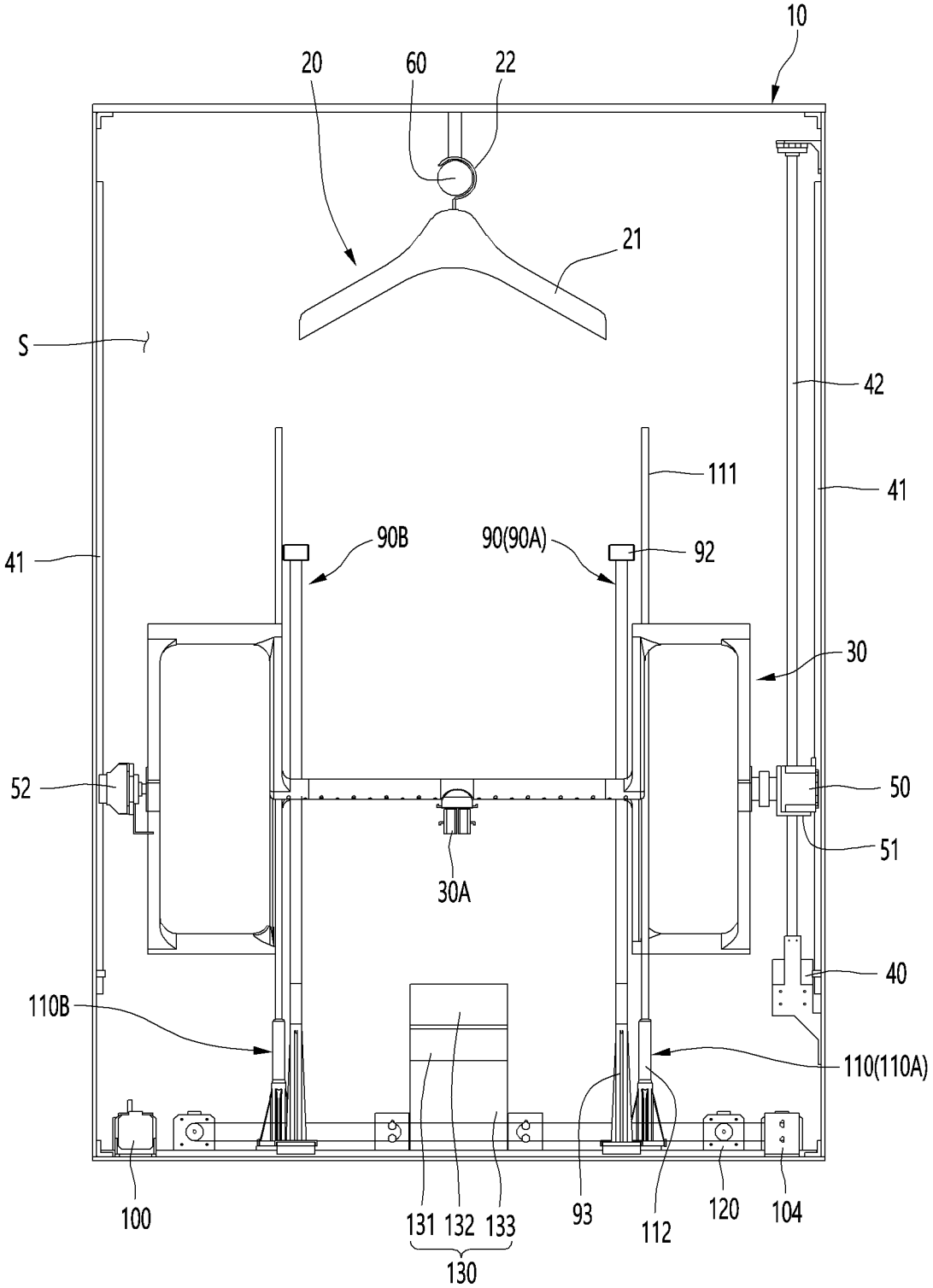
FIG. 1 is a front view illustrating a clothing processing apparatus according to an embodiment of the present disclosure.
Figure 2:
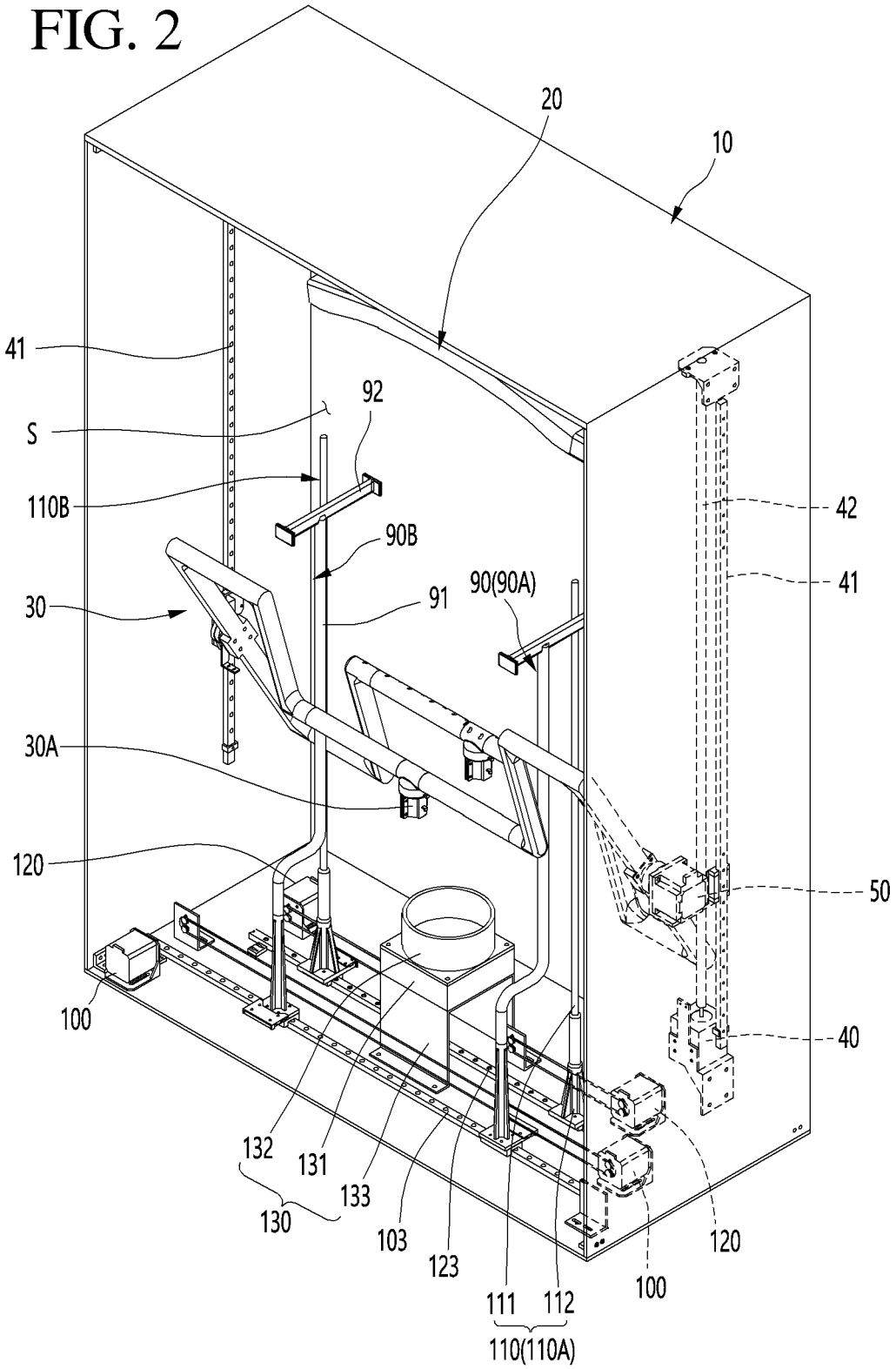
FIG. 2 is a perspective view illustrating a clothing processing apparatus according to an embodiment of the present disclosure.

FIG. 1 is a front view illustrating a clothing processing apparatus according to an embodiment of the present disclosure, and FIG. 2 is a perspective view illustrating a clothing processing apparatus according to an embodiment of the present disclosure.

The clothing processing apparatus according to the present embodiment may include a cabinet 10 in which a receiving space S for receiving clothing is formed.

The cabinet 10 may form the outer appearance of the clothing processing apparatus. The cabinet 10 may have a substantially rectangular box shape but is not limited thereto.

The clothing processing apparatus may further include a machine room (not illustrated). The machine room may be located inside or outside the cabinet 10. In a case where the machine room is located inside the cabinet 10, the machine room may be partitioned from the receiving space S. A plurality of devices including a steam generator (not illustrated) may be disposed in the inner portion of the machine room.

The steam generator may include a predetermined housing for storing water or passing water and a heater for heating the water in the housing. Accordingly, the steam generator can supply steam to the steamer 30 to be described later by heating water by the heater.

The clothing processing apparatus according to the present embodiment may include a holder 60 on which the clothing supporter 20 is held.

The holder 60 may be located in the receiving space S. The holder 60 may be supported by being fastened to or suspended from the upper portion of the cabinet 10. The holder 60 may be formed long in a front and rear direction. The holder 60 may have a circular bar shape.

The clothing supporter 20 may be held on the holder 60. The clothing supporter 20 may support the clothing C (see FIG. 6A). The clothing supporter 20 may be referred to as a clothing hanger.

In more detail, the clothing supporter 20 may include a hanging part 21 on which clothing is hung and a ring 22 for suspending the hanging part 21 on the holder 60.

The hanging part 21 may be disposed long in the left and right direction. The upper end of the hanging part 21 may be inclined in a direction in which the height decreases as the distance from the ring 22 increases. Clothing may be hung and supported on the upper end of the hanging part 21.

The ring 22 may be provided at the top center of the hanging part 21. The ring 22 may be hung on the holder 60.

A sensor (not illustrated) for determining whether the clothing supporter 20 is held may be provided on the holder 60.

For example, a groove (not illustrated) into which the ring 22 is fitted may be formed in the holder 60, and the sensor may include a light-emitting part located at one side of the groove and a light-receiving part located at the other side of the groove. When the ring 22 of the clothing supporter 20 is fitted into the groove, the light emitted from the light-emitting part is blocked by the ring 22, so that no light is incident on the light-receiving part. Accordingly, the sensor may detect that the clothing supporter 20 is held.

The clothing processing apparatus may include a steamer 30 to which steam is sprayed and an elevating motor 40 for elevating the steamer 30 in the vertical direction. The clothing processing apparatus may further include a rotation motor 50 for rotating the steamer 30.

The steamer 30 may be formed to be substantially long in the left and right direction. The steamer 30 may be located in the receiving space S of the cabinet 10. The steamer 30 may be movable in the vertical direction and may be constrained in the front and rear direction and the left and right direction.

The steamer 30 may refresh the clothing C by spraying steam toward the clothing C supported by the clothing supporter 20. In more detail, the steamer 30 can elevate in the vertical direction to scan the clothing C and spray steam to the clothing C at the same time as the scan, so that the wrinkles of the clothing C can be effectively spread.

The steamer 30 may be elevated in the vertical direction by the elevating motor 40. The configuration for converting the rotational force of the elevating motor 40 into vertical power is not limited.

As an example, the elevating motor 40 may rotate the lead screw 42 which is disposed long in the vertical direction, and a screw hole to which the lead screw 42 is fastened may be formed on the rotation motor bracket 51 to be described later. In this case, when the elevating motor 40 rotates the lead screw 42, the steamer 30, the rotation motor 50, the rotation motor bracket 51, and the guide bracket 52 may elevate together.

The elevating motor 40 may be disposed on the inner surfaces of the cabinet 10 in the left and right direction. The elevating motor 40 may be connected to at least one of both ends of the lead screw 42. For example, the elevating motor 40 may be connected to the lower end of the lead screw 42. In this case, guide bars 41 for guiding the elevation of the steamer 30 may be provided on the inner surfaces of the cabinet 10 in the left and right direction, respectively. The guide bar 41 may be disposed long in the vertical direction.

However, the present disclosure is not limited thereto, and of course, a configuration in which a rack gear formed long in the vertical direction on the inner surface of the cabinet 10 is provided and a pinion gear meshed with the rack gear is connected to the elevating motor 40 is also possible. In this case, the elevating motor 40 may be elevated together with the steamer 30.

At least one of both side portions of the steamer 30 may be connected to the rotation motor 50. For example, the rotation motor 50 may be connected to one of both side portions of the steamer 30 and the guide bracket 52 may be connected to the other. In other words, one of both side portions of the steamer 30 may be connected to the rotation motor 50, and the other may be rotatably connected to the guide bracket 52. However, the present disclosure is not limited thereto, and of course, a configuration in which both end portions of the steamer 30 are respectively connected to the rotation motor 50 is also possible.

Accordingly, the steamer 30 can be rotated by the rotation motor 50 to contact the clothing, and in this state, the steamer 30 can spray steam while elevating to effectively spread wrinkles or folds of the clothing C. In addition, the steamer may spray steam on the clothing C at various angles.

A rotation motor bracket 51 on which the rotation motor 50 is mounted may be fastened to the steamer 30.

A guide groove into which the guide bar 41 is fitted is formed in the rotation motor bracket 51 and the guide bracket 52, or a separate guide block 51A (see FIG. 4) into which the guide bar 41 is fitted may be provided. Accordingly, the elevation of the steamer 30, the guide bracket 52, the rotation motor bracket 51, and the rotation motor 50 may be guided by the guide bar 41.

In addition, a steam injector 30A may be formed in the steamer 30. A steam hose (not illustrated) connected to the steam generator (not illustrated) may be connected to the steam injector 30A. Accordingly, the steam generated by the steam generator may flow into the steamer 30.

Meanwhile, in a case where the clothing C (see FIG. 7A) are hung on the clothing supporter 20 held on the holder 60 since the arms C2 and C3 of the clothing C droop downward, an overlapping portion is inevitably formed between the body C1 and the arms C2 and C3, and wrinkles occur. In this state, in a case where the steamer 30 elevates and sprays steam to refresh the clothing C, there is a risk that the wrinkles cannot be removed and wrinkles may become worse.

In order to solve this risk, the clothing processing apparatus according to the present embodiment may include a separator 90 that separates the body C1 and arms C2 and C3 of the clothing C, and a separator moving motor 100 that moves the separator 90 in the left and right direction.

The separator 90 may move in the left and right direction and move between the body C1 and the arms C2 and C3 of the clothing C to separate the body C1 and the arms C2 and C3.

A pair of separators 90 may be provided. In other words, the pair of separators 90 may include a first separator 90A and a second separator 90B.

The first separator 90A separates the body C1 of the clothing C (see FIG. 7A) and one arm C2, and the second separator 90B may separate the body C1 of the clothing C and the other arm C3.

The first separator 90A and the second separator 90B can each independently move in the left and right direction.

The separator 90 may include a moving bar 91 that is formed long in the vertical direction, and a separate part 92 that is formed long in the front and rear direction at the upper end of the moving bar 91. The separator 90 may further include a moving body 93 to which a lower end of the moving bar 91 is fastened and which is moved by the separator moving motor 100.

The moving bar 91 may be formed long in the vertical direction. The moving bar 91 may be formed by a combination of a straight part and a curved part. Accordingly, the moving bar 91 can move in the left and right direction while avoiding interference with other components disposed in the inner space of the cabinet 10—for example, the blower 130.

The moving bar 91 may pass through the inside of the steamer 30 forming a closed curve. Accordingly, the separator 90 can move in the left and right direction without interfering with the steamer 30.

A separate part 92 may be formed at the upper end of the moving bar 91. The separate part 92 may be formed long from the upper end of the moving bar 91 in the front and rear direction. The separate part 92 may include extension parts 92A formed at both ends.

The lower end of the moving bar 91 is fastened to the moving body 93 to move together with the moving body 93. The moving body 93 may move along the separator guide rail 103 in the left and right direction by the separator moving motor 100.

The separator guide rail 103 may be provided on an inner bottom surface of the cabinet 10. The separator guide rails 103 may be disposed long in the left and right direction.

The separator moving motor 100 may be provided on an inner bottom surface of the cabinet 10. A pair of separator moving motors 100 may be provided. One of the pair of separator moving motors 100 may move the first separator 90A, and the other may move the second separator 90B.

A configuration in which the separator moving motor 100 moves the separator 90 will be described in detail later.

Meanwhile, the clothing processing apparatus according to the present embodiment may include a spreader 110 for applying a mechanical force to the clothing C (see FIG. 10A), and a spreader moving motor 120 for moving the spreader 110 in the left and right direction. The clothing processing apparatus according to the present embodiment may further include a blower 130 that assists the operation of the spreader 110.

The spreader 110 may move in the left and right direction and move into the body C1 of the clothing C to apply a mechanical force so that the body C1 is tautly tensioned.

A pair of spreaders 110 may be provided. In other words, the pair of spreaders 110 may include a first spreader 110A and a second spreader 1108.

The first spreader 110A can press the body from the inner portion of one side of the body C1 of the clothing C to the outside, and the second spreader 1108 can press the body C1 from the inner portion of the other side of the body C1 of the clothing C to the outside. In other words, the pressing directions of the first spreader 110A and the second spreader 1108 may be opposite to each other, and thus the body C1 of the clothing C may be tautly tensioned.

The first spreader 110A and the second spreader 1108 may each independently move in the left and right direction.

The first spreader 110A and the second spreader 1108 may be located opposite to each other with respect to the blower 130. In other words, the first spreader 110A may move from one side of the blower 130 in the left and right direction, and the second spreader 1108 may move from the other side of the blower 130 in the left and right direction. This is because the movement range of the spreader 110 in the left and right direction does not need to be as large as that of the separator 90. With the above configuration, the clothing processing apparatus may be compact.

The spreader 110 is formed long in the vertical direction and may include the tension part 111 that moves into the body C1 of the clothing C, and a moving body 112 to which the tension part 111 are connected and that moves in the left and right direction by the spreader moving motor 120.

The tension part 111 may be formed long in the vertical direction. The length of the tension part 111 may be variable. In more detail, the tension part 111 may have a multi-stage structure with a variable length. This may have a structure similar to that of a conventional antenna with a variable length.

The tension part 111 may have a predetermined elasticity with respect to the horizontal direction. Accordingly, the tension part 111 can be bent according to the inner shape of the body C1 of the clothing C and can reliably tension the body C1.

The tension part 111 may be maintained at a minimum length in normal times. In this case, the tension part 111 may have a length that does not interfere with the rotating steamer 30.

When a mechanical force is applied to the clothing C, the tension part 111 may extend long upwardly as illustrated in FIGS. 1 and 2. In this case, the tension part 111 may extend to a length inserted into the body C1 of the clothing C.

The extended tension part 111 may pass through the inner portion of the steamer 30 forming a closed curve. Accordingly, the spreader 110 can move in the left and right direction without interfering with the steamer 30.

The tension part 111 may be connected to the moving body 112 and move together with the moving body 112. The moving body 112 may move in the left and right direction along the spreader guide rail 123 by the spreader moving motor 120.

The spreader guide rail 123 may be provided on an inner bottom surface of the cabinet 10. The spreader guide rail 123 may be disposed long in the left and right direction.

The spreader guide rail 123 may be spaced apart from the separator guide rail 103 in the front and rear direction. The spreader guide rail 123 may be disposed in parallel with the separator guide rail 103.

The spreader moving motor 120 may be provided on an inner bottom surface of the cabinet 10. A pair of spreader moving motors 120 may be provided. One of the pair of spreader moving motors 120 may move the first spreader 110A, and the other may move the second spreader 1108.

A configuration in which the spreader moving motor 120 moves the spreader 110 will be described in detail later.

Meanwhile, the blower 130 may be disposed in the inner portion of the cabinet 10 and blow air into the body C1 of the clothing C from the lower side of the clothing C.

The blower 130 may be provided on an inner bottom surface of the cabinet 10. The blower 130 may generate an upward-facing air flow so that the body C1 of the clothing C is opened. As a result, the spreader 110 extends upward and can easily move into the body C1 of the clothing C.

In more detail, the blower 130 may include a blowing fan 131, an air guide 132 for guiding the air blown by the blowing fan 131, and a blowing fan supporting part 133 for supporting the blowing fan 131.

The blowing fan 131 may be disposed toward the upper side and may blow air upward.

The air guide 132 may be located above the blowing fan 131. The air guide 132 may minimize the spread of the air blown by the blowing fan 131 and guide the air to flow into the body C1 of the clothing C.

In more detail, the air guide 132 may include a plate part coupled to the upper side of the blowing fan 131, and a guide part protruding upward from the plate part and having a hollow shape.

The blowing fan supporting part 133 may support the blowing fan from the lower side. The blowing fan supporting part 133 may have a box shape with both side surfaces and an opened bottom surface. The spreader guide rail may be disposed through the inner portion of the blowing fan supporting part 133. Thereby, the clothing processing apparatus can be made compact.

Figure 3:
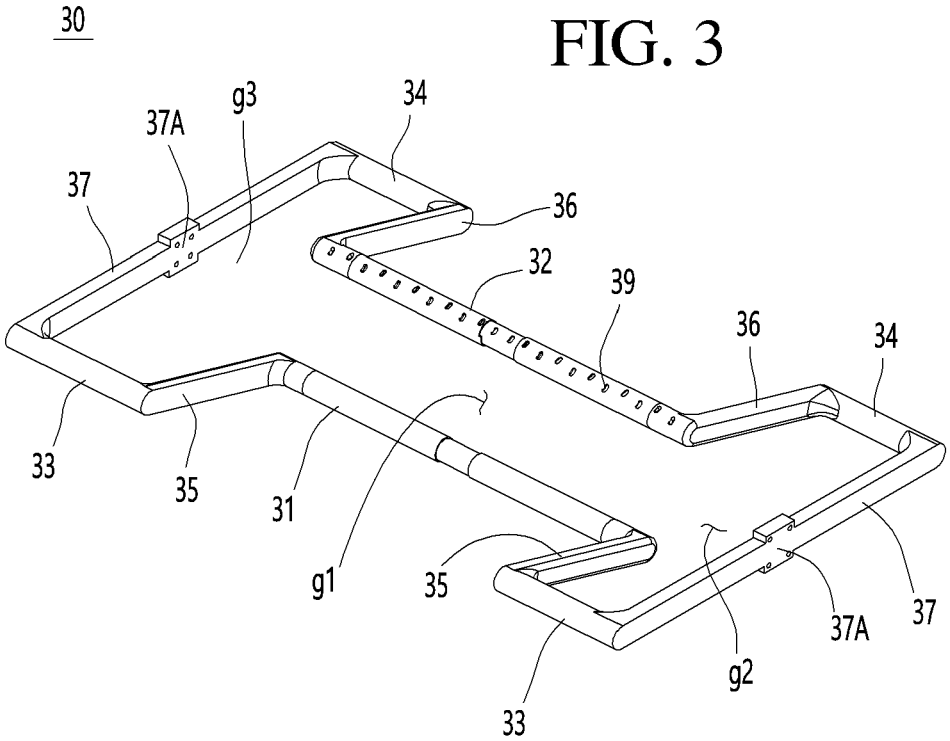
FIG. 3 is a view for explaining the configuration of a steamer according to an embodiment of the present disclosure.

FIG. 3 is a view for explaining the configuration of a steamer according to an embodiment of the present disclosure.

The steamer 30 may form a single closed curve.

In more detail, the steamer 30 may include a front steam body 31, a rear steam body 32, a pair of front auxiliary bodies 33, a pair of rear auxiliary bodies 34, a pair of front connection parts 35, a pair of rear connection parts 36, and a pair of outer connection parts 37.

The front steam body 31 and the rear steam body 32 may have a bar shape formed long in the left and right direction. The front steam body 31 and the rear steam body 32 may be disposed side by side.

The front steam body 31 and the rear steam body 32 may be spaced apart in the front and rear direction. In this case, it is preferable that the front steam body 31 and the rear steam body 32 are not located on the same horizontal plane.

The clothing C hung on the clothing supporter 20 may move g1 between the front steam body 31 and the rear steam body 32.

The front steam body 31 may spray steam toward the front surface of the clothing C hung on the clothing supporter 20, and the rear steam body 32 may spray steam toward the back surface of the clothing C hung on the clothing supporter 20.

The front steam body 31 and the rear steam body 32 may be provided with a plurality of steam spraying parts 39 toward the clothing C. The steam spraying part 39 may be configured as a hole or a nozzle.

In more detail, the front steam body 31 may be formed with a plurality of steam spraying parts 39 facing the rear. In addition, the rear steam body 32 may be formed with a plurality of steam spraying parts 39 facing the front. However, it is preferable that each of the steam spraying parts 39 is provided to face a direction forming a predetermined angle to a horizontal direction.

In addition, the steam injector 30A (see FIG. 1) described above may be fastened to the front steam body 31 and the rear steam body 32.

An inner steam flow path for guiding the steam injected to the steam injector 30A to each steam spraying part 39 may be formed in the front steam body 31 and the rear steam body 32. Accordingly, steam may be sprayed from the steam spraying part 39 toward the clothing C.

The front auxiliary body 33 and the rear auxiliary body 34 may have a bar shape which is formed long in the left and right direction. The front auxiliary body 33 and the rear auxiliary body 34 may be disposed side by side.

The front auxiliary body 33 and the rear auxiliary body 34 may be spaced apart from each other in the front and rear direction.

The front auxiliary body 33 may be located more forward than the front steam body 31, and the rear auxiliary body 34 may be located more rearward than the rear steam body 32.

The outer end portion of the front auxiliary body 33 may be located more outside than the end portion of the front steam body 31. The outer end portion of the rear auxiliary body 34 may be located more outside than the end portion of the rear steam body 32.

In a case where one arm C2 of the clothing C (see FIGS. 8A and 8B) is separated from the body C1 by the separator 90 and droops downward, the one arm C2 can be located a space g1 between the front steam body 31 and the rear steam body 32, and the body C1 and the other arm C3 may be located a space g3 between the front auxiliary body 33 and the rear auxiliary body 34.

In a case where the other arm C3 of the clothing C (see FIGS. 9A and 9B) is separated from the body C1 by the separator 90 and droops downward, the other arm C3 may be located a space g1 between the front steam body 31 and the rear steam body 32, and the body C1 and one arm C2 are may be located a space g2 between the front auxiliary body 33 and the rear auxiliary body 34.

The distance between the front auxiliary body 33 and the rear auxiliary body 34 in the front and rear direction may be greater than the distance between the front steam body 31 and the rear steam body 32 in the front and rear direction. Accordingly, there is an advantage that any one of the body C1 and the arms C2 and C3 of the clothing C can smoothly move between the front auxiliary body 33 and the rear auxiliary body 34, and the wrinkle of the clothing C can be minimized.

The front connection part 35 may connect the front steam body 31 and the front auxiliary body 33 to each other.

The front connection part 35 may be formed long forward from the end portion of the front steam body 31. In more detail, the front connection part 35 may be formed long in a direction forming a predetermined angle with respect to the horizontal direction.

The rear connection part 36 may connect the rear steam body 32 and the rear auxiliary body 34 to each other.

The rear connection part 36 may be formed long rearward from the end portion of the rear steam body 32. In more detail, the rear connection part 36 may be formed long in a direction forming a predetermined angle with respect to the horizontal direction.

The outer connection part 37 may connect the front auxiliary body 33 and the rear auxiliary body 34 to each other. In more detail, the outer connection part 37 may connect the outer end portion of the front auxiliary body 33 and the outer end portion of the rear auxiliary body 34.

The outer connection part 37 may be formed long in the front and rear direction.

At least one of the pair of outer connection parts 37 may be connected to the rotation motor 50. For example, the rotation motor 50 (see FIG. 1) may be connected to any one of the pair of outer connection parts 37, and the guide bracket 52 may be connected to the other outer connection part. In other words, one of both end portions of the steamer 30 may be connected to the rotation motor 50, and the other end portion may be rotatably connected to the guide bracket 52. However, the present disclosure is not limited thereto, and of course, a configuration in which both end portions of the steamer 30 are respectively connected to the rotation motor 50 is also possible.

In more detail, a fastening part 37A to which a coupler connecting the steamer 30 to the rotation motor bracket 51 and the guide bracket 52 is fastened may be formed in the outer connection part 37. The fastening part 37A is preferably formed on the middle part of the outer connection part 37.

Accordingly, the steamer 30 can be rotated by the rotation motor 50 to contact the clothing, and in this state, the steamer 30 can spray steam to effectively spread wrinkles or turns of the clothing C while elevating. In addition, steam may be sprayed on the clothing C at various angles.

Figure 4:
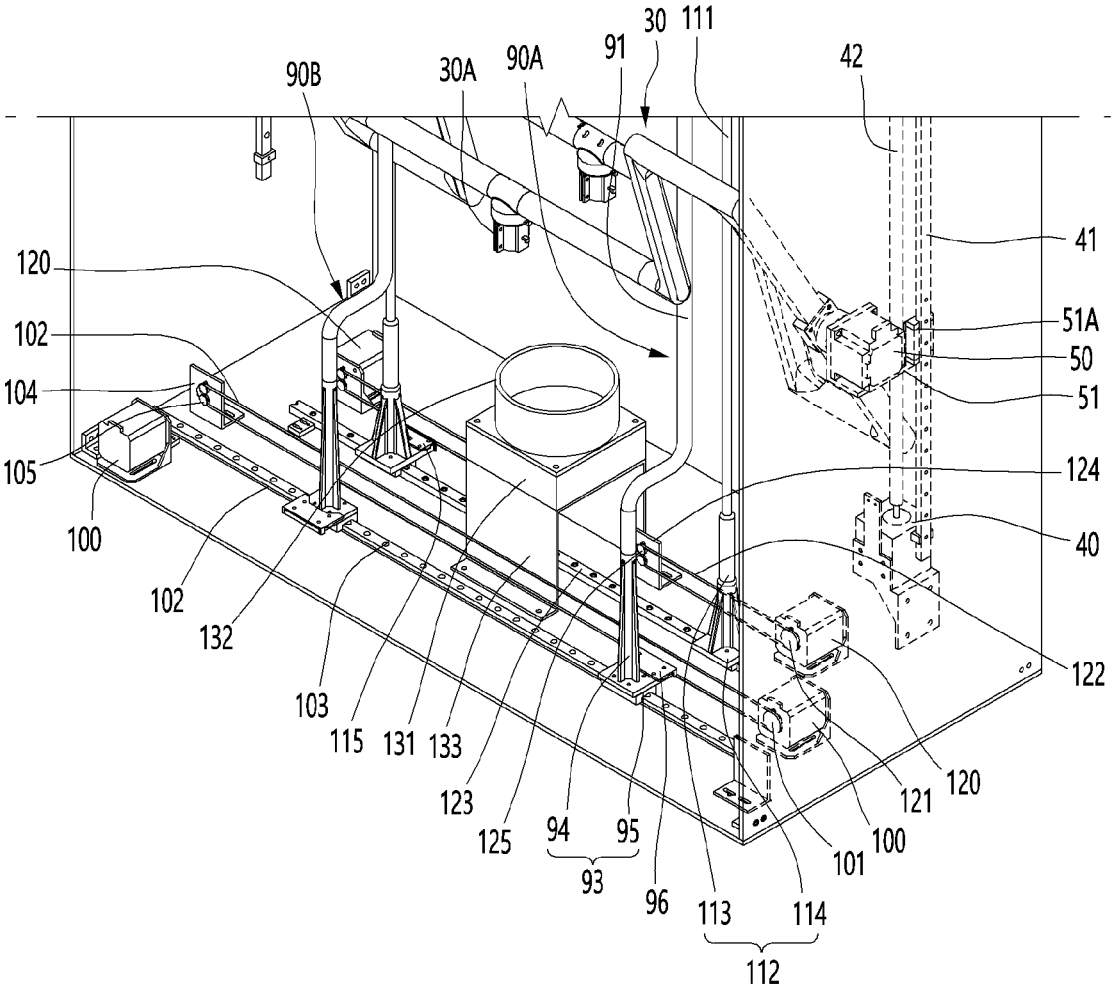
FIG. 4 is an enlarged view illustrating a lower portion of the clothing processing apparatus illustrated in FIG. 2.

FIG. 4 is an enlarged view illustrating a lower portion of the clothing processing apparatus illustrated in FIG. 2.

The moving body 93 of the separator 90 may include a main body 94 to which the moving bar 91 is fastened, and a guide block 95 moving along the separator guide rail 103.

The main body 94 may have a tubular shape formed long in the vertical direction. The lower end of the moving bar 91 may be inserted into the main body 94 to be fitted thereinto. A plurality of ribs for reinforcing rigidity may be formed on the outer circumference of the main body 94. The plurality of ribs may be connected to the guide block 95.

A main body 94 may be coupled to the guide block 95. The guide block 95 may be integrally formed with the main body 94 but is not limited thereto.

A guide groove into which the separator guide rail 103 is fitted may be formed on the bottom surface of the guide block 95. Accordingly, the guide block 95 may be guided to move along the separator guide rail 103 in the left and right direction.

The moving body 93 of the separator 90 may be provided with a belt holder 96 to which the power of the separator moving motor 100 is transmitted. The belt holder 96 may hold the belt 102 rotating by the separator moving motor 100.

The belt holder 96 may be fastened to the guide block 95 at the front or rear of the guide block 95. The belt holder 96 can be moved by the power of the belt 102 rotating by the separator moving motor 100. Thereby, the entire separator 90 can move smoothly in the left and right direction.

The separator moving motor 100 may be provided on an inner bottom surface of the cabinet 10. A pair of separator moving motors 100 may be provided. One of the pair of separator moving motors 100 may move the first separator 90A, and the other may move the second separator 90B.

The pair of separator moving motors 100 may be located opposite to each other with respect to the separator guide rail 103. Accordingly, the belt 102 connected to each separator moving motor 100 can rotate smoothly without interfering with each other.

For example, the separator moving motor 100 for moving the first separator 90A is located behind the separator guide rail 103, and the separator moving motor 100 for moving the second separator 90B can be located in front of the separator guide rail 103.

In this case, the belt holder 96 of the first separator 90A is fastened from the rear of the guide block 95 of the first separator 90A, and the belt holder 96 of the second separator 90B may be fastened in front of the guide block 95 of the second separator 90B.

The power of the separator moving motor 100 may be transmitted to the separator 90 through the belt 102. In more detail, one side of the belt 102 forming a closed curve is in contact with the rotary pulley 101 connected to the separator moving motor 100, and the other side of the belt may be in contact with the support pulley 105 installed in the separator pulley bracket 104. When the rotary pulley 101 rotates, the belt 102 may rotate by the frictional force between the rotary pulley 101 and the belt 102. In this case, the support pulley 105 may support the belt 102 while rotating by frictional force with the belt 102.

The belt holder 96 of the separator 90 may be connected to the belt 102. Accordingly, the separator 90 can move in the left and right direction according to the rotation of the belt 102.

However, the present disclosure is not limited thereto, and of course, a configuration in which a rotation gear is connected to the separator rotation motor 100, a chain is connected to the rotation gear, and a belt holder 96 of the separator 90 is connected to the chain is also possible.

The separator guide rail 103 may be provided on an inner bottom surface of the cabinet 10. The separator guide rails 103 may be disposed long in the left and right direction. The separator guide rail 103 may be fitted into the guide groove formed in the guide block 95 of the separator 90 to guide the movement of the separator 90 in the left and right direction.

The separator pulley bracket 104 may be provided on an inner bottom surface of the cabinet 10. A pair of separator pulley brackets 104 may be also provided similarly to the separator moving motor 100. The pair of separator pulley brackets 104 may be located opposite to each other with respect to the separator guide rail 103.

The separator pulley bracket 104 connected to one of the separator moving motors 100 and the belt 102 may face the other separator moving motor 100 in the front and rear direction. Accordingly, the movement range of the separator 90 in the left and right direction can be secured to the maximum for the limited length of the belt 102.

Meanwhile, the moving body 112 of the spreader 110 may include a main body 113 to which the tension part 111 is connected, and a guide block 114 located below the main body 94 and moving along the spreader guide rail 123.

The main body 113 may have a tubular shape formed long in the vertical direction. The lower end of the tension part 111 may be inserted into the main body 113 to be fitted thereinto. A plurality of ribs for reinforcing rigidity may be formed on the outer circumference of the main body 113. The plurality of ribs may be connected to the guide block 114.

A main body 113 may be coupled to the guide block 114. The guide block 114 may be formed integrally with the main body 113 but is not limited thereto.

A guide groove into which the spreader guide rail 123 is fitted may be formed on the bottom surface of the guide block 114. Accordingly, the guide block 114 may be guided to move along the spreader guide rail 123 in the left and right direction.

The moving body 112 of the spreader 110 may be provided with a belt holder 115 to which the power of the spreader moving motor 120 is transmitted. The belt holder 115 may hold the belt 122 rotating by the spreader moving motor 120.

The belt holder 115 may be fastened to the guide block 114 at the front or rear of the guide block 114. The belt holder 115 may be moved by the power of the belt 122 rotating by the spreader moving motor 120. Accordingly, the spreader 110 as a whole can move smoothly in the left and right direction.

The spreader moving motor 120 may be provided on an inner bottom surface of the cabinet 10. A pair of spreader moving motors 120 may be provided. One of the pair of spreader moving motors 120 may move the first spreader 110A, and the other may move the second spreader 1106.

The pair of spreader moving motors 120 may be located opposite to each other with respect to the blower 130.

The power of the spreader moving motor 120 may be transmitted to the spreader 110 through the belt 122. In more detail, one side of the belt 122 forming a closed curve may be in contact with the rotary pulley 121 connected to the spreader moving motor 120, and the other side may be in contact with the support pulley 125 installed in the spreader pulley bracket 124. When the rotary pulley 121 rotates, the belt 122 may rotate by the frictional force between the rotary pulley 121 and the belt 122. In this case, the support pulley 125 may support the belt 122 while rotating by frictional force with the belt 122.

The belt holder 115 of the spreader 110 may be connected to the belt 122. Accordingly, the spreader 110 may move in the left and right direction according to the rotation of the belt 122.

However, the present disclosure is not limited thereto, and of course, a configuration in which a rotation gear is connected to the spreader rotation motor 120, a chain is connected to the rotation gear, and a belt holder 115 of the spreader 110 is connected to the chain is also possible.

The spreader guide rail 123 may be provided on an inner bottom surface of the cabinet 10. The spreader guide rail 123 may be disposed to be long in the left and right direction. The spreader guide rail 123 may be fitted into the guide groove formed in the guide block 114 of the spreader 110 to guide the movement of the spreader 110 in the left and right direction.

The spreader guide rail 123 may be spaced apart from the separator guide rail 103 in the front and rear direction. The spreader guide rail 123 may be disposed in parallel with the separator guide rail 103.

The length of the spreader guide rail 123 may be shorter than the length of the separator guide rail 103. The spreader guide rail 123 may pass through the inner portion of the blowing fan supporting part 133, and the separator guide rail 103 may pass through the outer front or outer rear of the blowing fan supporting part 133.

The spreader pulley bracket 124 may be provided on the inner bottom surface of the cabinet 10. A pair of spreader pulley brackets 124 may be provided similarly to the spreader moving motor 120.

The length of the belt 122 connecting the spreader moving motor 120 and the spreader pulley bracket 124 in the left and right direction may be shorter than the length of the belt 102 connecting the separator moving motor 100 and the separator pulley bracket 124 in the left and right direction. In more detail, the length of the belt 122 connecting the spreader moving motor 120 and the spreader pulley bracket 124 in the left and right direction may be less than half of the length of the belt 102 connecting the separator moving motor 100 and the separator pulley bracket 124 in the left and right direction.

Figure 5:
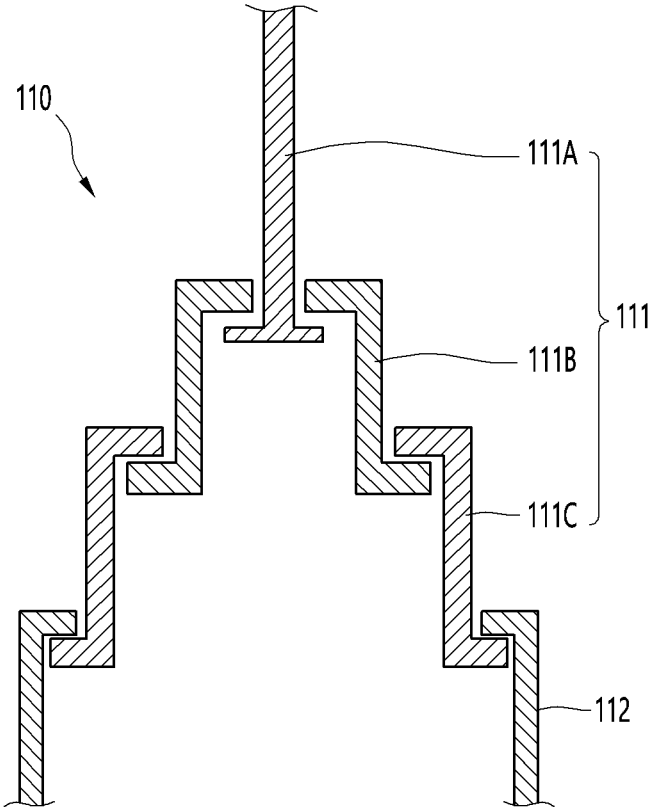
FIG. 5 is a view for explaining a tension part of a spreader according to the embodiment of the present disclosure.

FIG. 5 is a view for explaining a tension part of a spreader according to the embodiment of the present disclosure.

As described above, the tension part 111 of the spreader 110 may have a multi-stage structure in which the length is variable.

In more detail, the tension part 111 may include an insertion part 111A, at least a part of which is inserted into the body C1 of the clothing C (see FIG. 10A), and at least one hollow part 111B and 111C which connects the insertion part 111A and the moving body 112 to each other. Hereinafter, a case where the first hollow part 111B and the second hollow part 111C are included in the tension part 111 will be described as an example.

The insertion part 111A, the first hollow portion 111B, and the second hollow portion 111C may be formed long in the vertical direction.

The insertion part 111A may be received in the first hollow part 111B, the first hollow part 111B may be received in the second hollow part 111C, and the second hollow part 111C may be received in the main body 113 of the moving body 112.

The outer diameter of the insertion part 111A is smaller than the inner diameter of the first hollow part 111B, the outer diameter of the first hollow part 111B is smaller than the inner diameter of the second hollow part 111C, and the outer diameter of the second hollow part 111C may be smaller than the inner diameter of the main body 113 of the moving body 112.

The inner portion of the first hollow portion 111B, the second hollow portion 111C, and the main body 113 may communicate with each other.

A first hanging part hung on the upper end of the first hollow portion 111B may be formed on the lower end of the insertion part 111A. A second hanging part hung on the upper end of the second hollow part 111C may be formed on the lower end of the first hollow part 111B. A third hanging part hung on the upper end of the main body 113 of the moving body 112 may be formed on the lower end of the second hollow part 111C.

With the configuration of the tension part 111, the length of the tension part 111 in the vertical direction can be easily variable. Accordingly, the insertion part 111A may extend upwardly from the moving body 112 to be inserted into the body C1 of the clothing C.

Figure 6A:
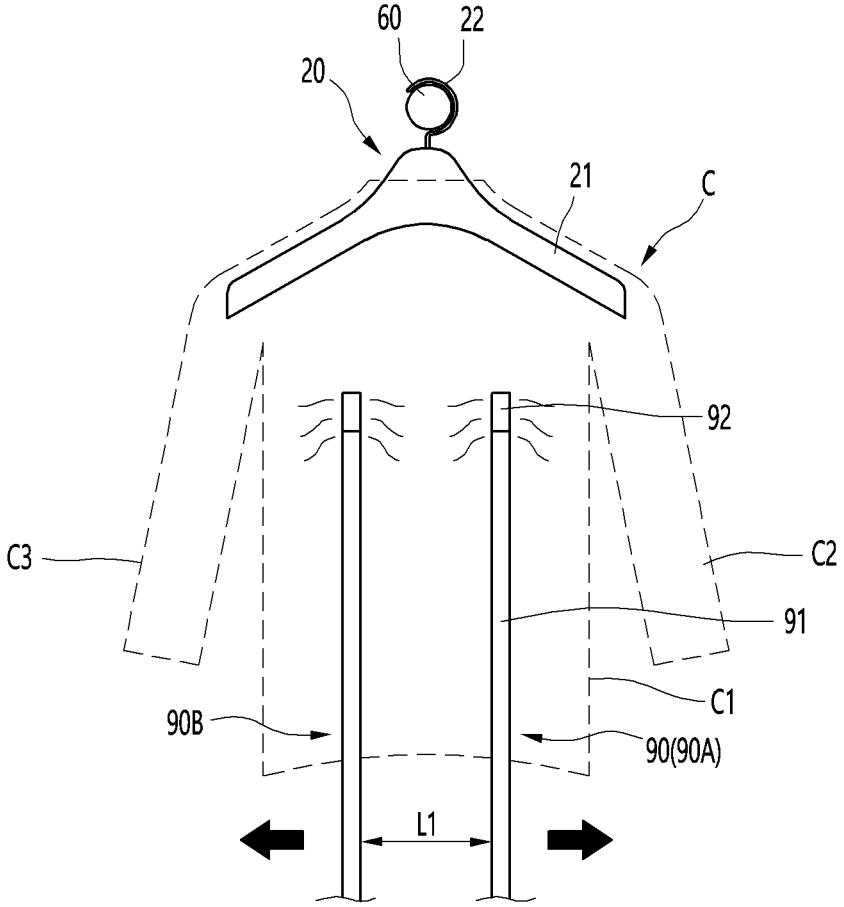
FIGS. 6A and 6B are views illustrating an initial position of a separator according to an embodiment of the present disclosure.
Figure 6B:
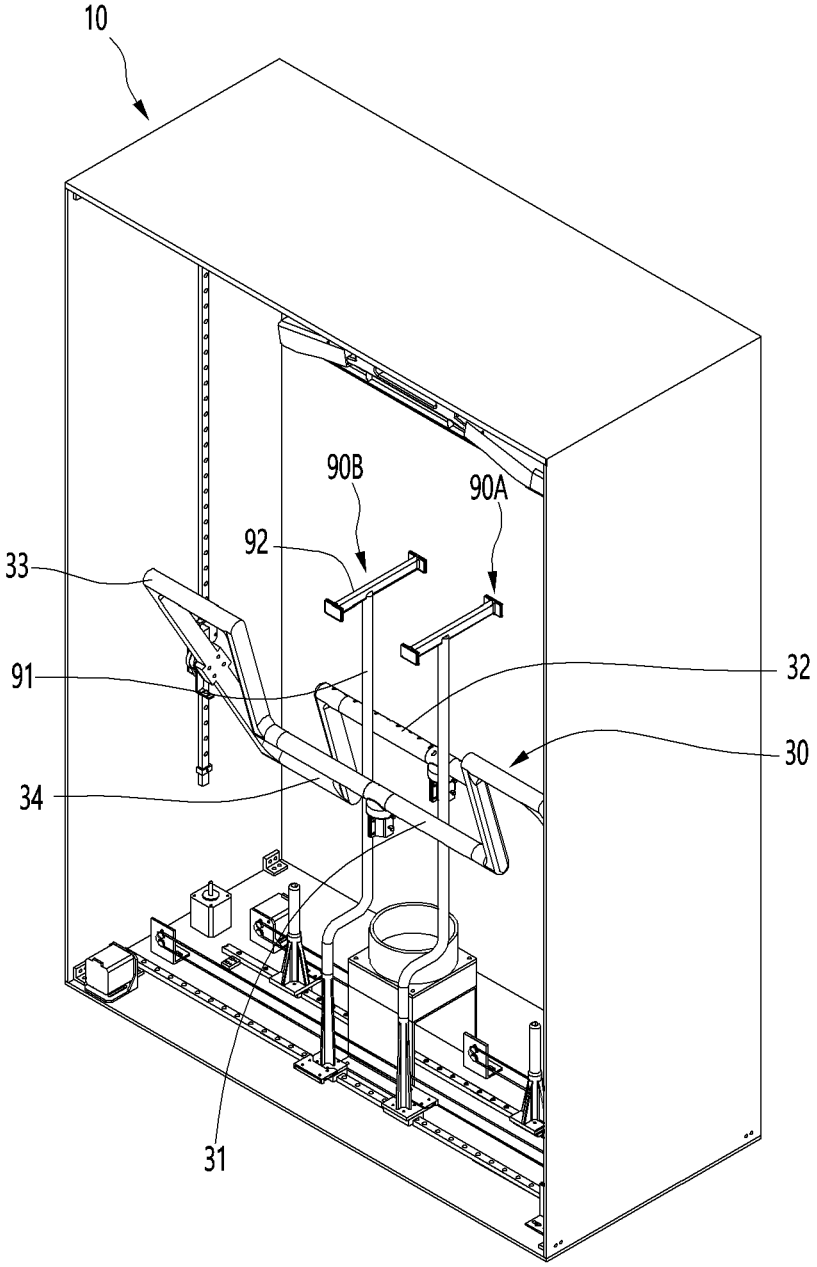

FIGS. 6A and 6B are views illustrating an initial position of a separator according to an embodiment of the present disclosure. In more detail, FIG. 6A is a view for explaining the positional relationship between the separator and the clothing hung on the clothing supporter, and FIG. 6B is a view for explaining the positional relationship between the separator and the steamer.

The distance L1 between the pair of separators 90 in the left and right direction, which are in the initial position state may be shorter than the width of the body C1 of the clothing C in the left and right direction. Accordingly, when the clothing supporter 20 is held on the holder 60, the body C1 of the clothing C hung on the clothing supporter 20 may be in a state of being in contact by the separate parts 92 of each of the pair of separators 90. In this case, the separator 90 may be located at the front or rear of the body C1 of the clothing C.

In this case, the pair of separators 90 may be located a space g1 between the front steam body 31 and the rear steam body 32 of the steamer 30 (see FIG. 3).

Figure 7A:
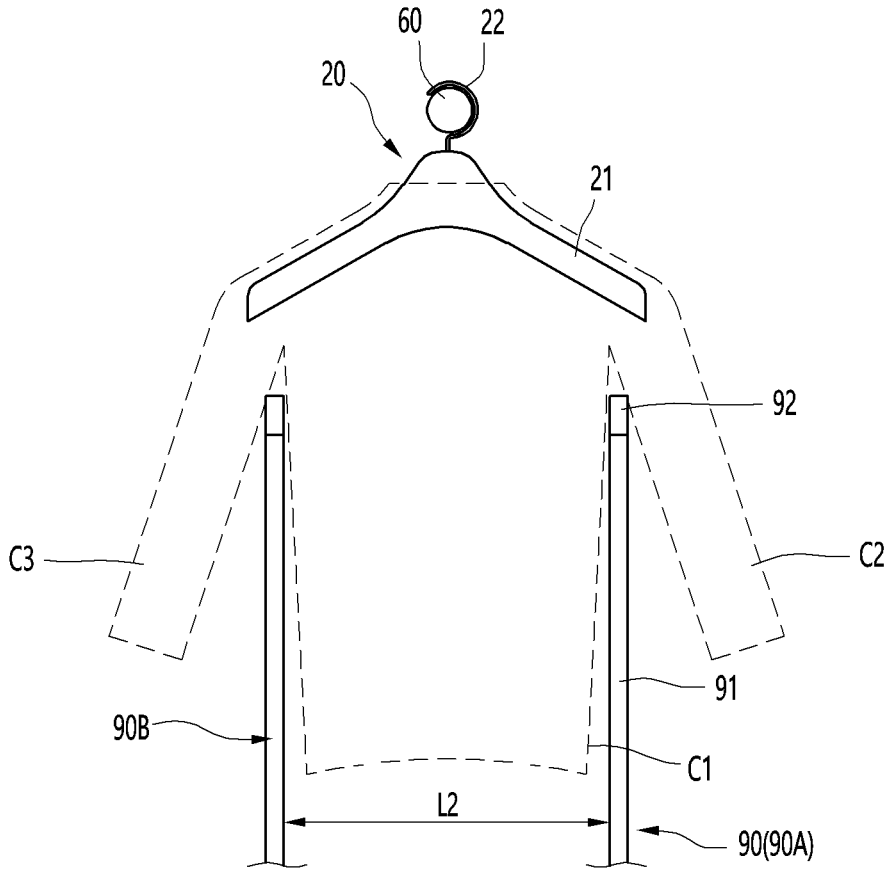
FIGS. 7A and 7B are views illustrating a state where a separator is moved between a body and an arm of clothing according to an embodiment of the present disclosure.
Figure 7B:
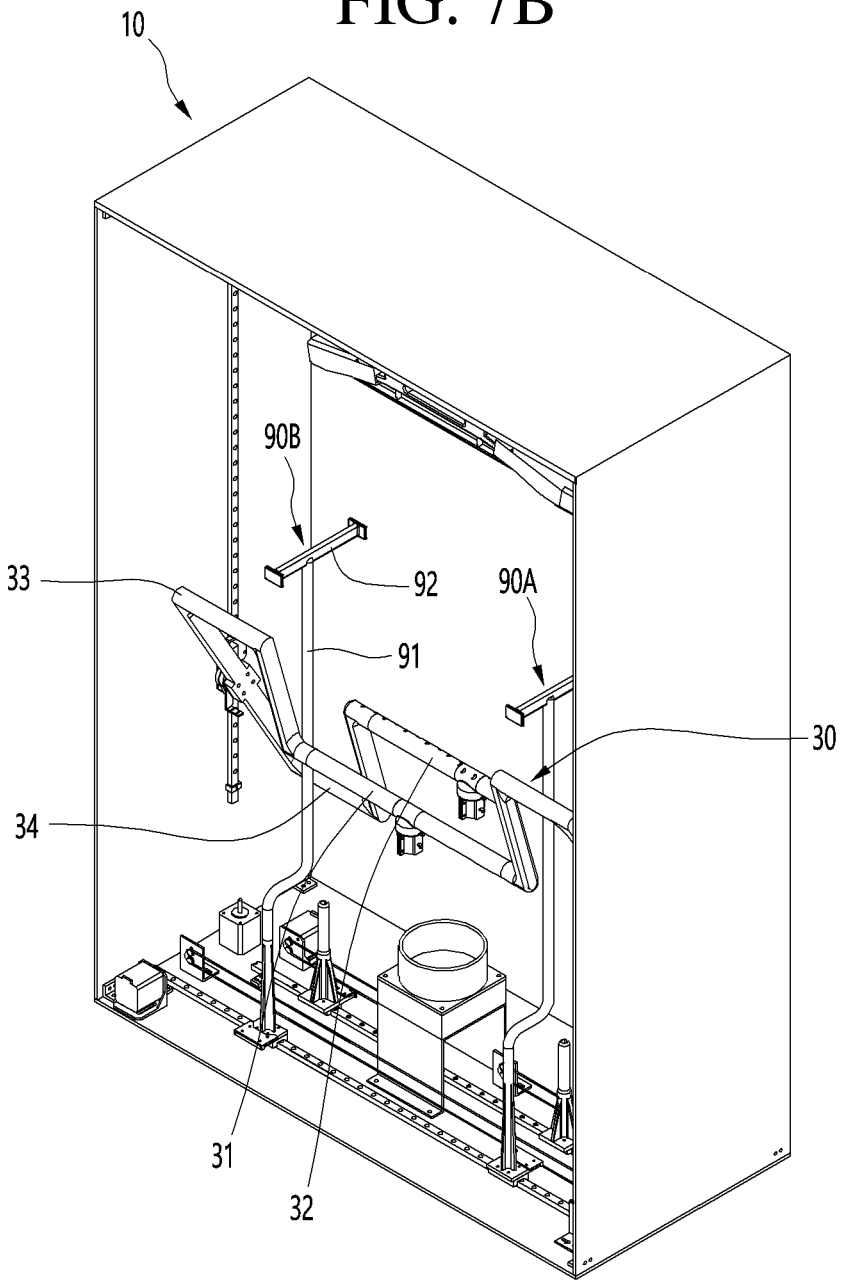

FIGS. 7A and 7B are views illustrating a state where a separator is moved between a body and an arm of clothing according to an embodiment of the present disclosure. In more detail, FIG. 7A is a view for explaining the positional relationship between the separator and the clothing hung on the clothing supporter, and FIG. 7B is a view for explaining the positional relationship between the separator and the steamer.

In a state where the separator 90 moves between the body and the arm of the clothing, the distance L2 between the pair of separators 90 in the left and right direction may be greater than the distance L1 between the pair of separators 90 in the left and right direction, which are in the initial position. In other words, the pair of separators 90 may move away from each other from the initial position and move between the body C1 and the arms C2 and C3 of the clothing C.

In more detail, the pair of separators 90 at their initial positions may move in a direction away from each other in a state of being in contact with the body C1 of the clothing C, and when the separate part 92 of the separator 90 reaches between the body C1 and the arms C2 and C3, the separate part 92 may naturally move between the body C1 and the arms C2 and C3 due to the sagging of the clothing C.

In more detail, the first separator 90A may be moved between the body C1 and one of the arms C2 of the clothing C, and the second separator 90B may be moved between the body C1 and the other of the arms C3 of the clothing C.

Since the separate part 92 of the separator 90 is formed long in the front and rear direction, the separate part 92 can reliably separate the body C1 and the arms C2 and C3 of the clothing C.

The pair of separators 90 may be configured to stop moving as soon as the pair of separators 90 move between the body C1 and the arms C2 and C3 of the clothing C. Alternatively, the pair of separators 90 may move further apart by a predetermined distance even after the pair of separators 90 move between the body C1 and the arms C2 and C3 of the clothing C.

Figure 8A:
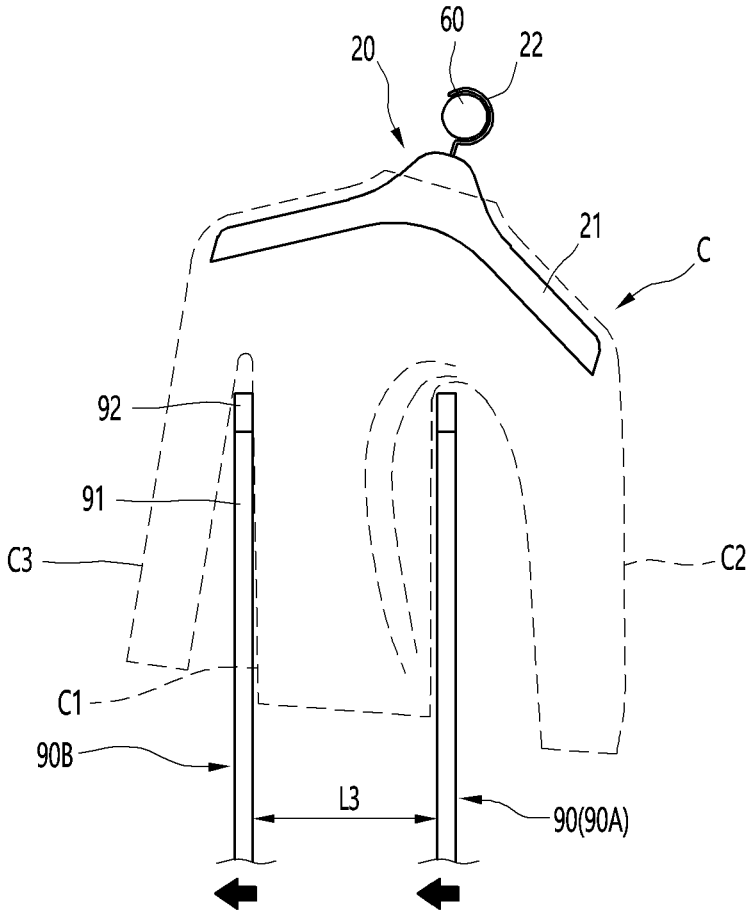
FIGS. 8A and 8B are views for explaining the operation of the separator for refreshing one arm of clothing.
Figure 8B:
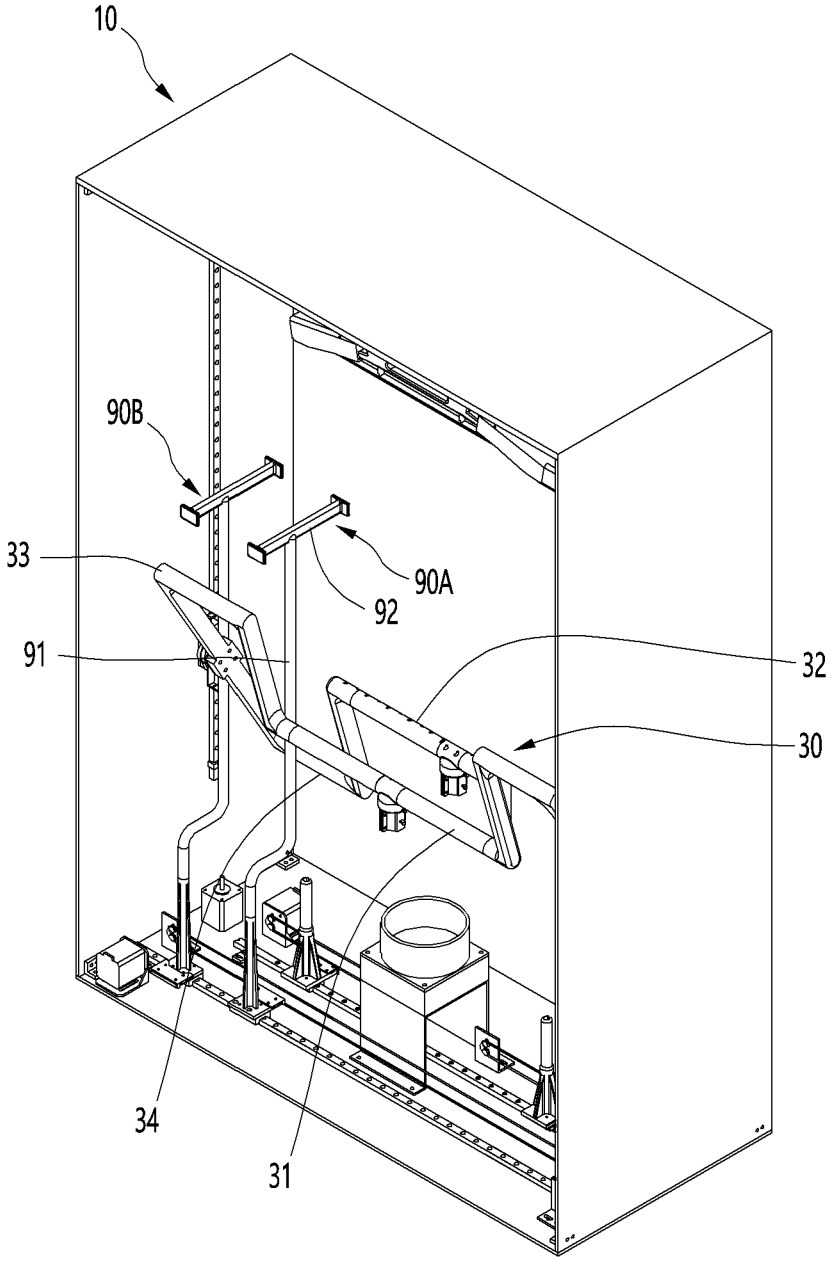

FIGS. 8A and 8B are views for explaining the operation of the separator for refreshing one arm of clothing. In more detail, FIG. 8A is a view for explaining the positional relationship between the separator and the clothing hung on the clothing supporter, and FIG. 8B is a view for explaining the positional relation between the separator and the steamer.

The separator 90 may move in one direction to separate one arm C2 of the clothing C from the body C1 and droop one arm downward.

In more detail, the first separator 90A and the second separator 90B may each move in one direction by a predetermined distance. In this case, the first separator 90A may move more than the second separator 90B. Accordingly, the distance L3 between the first separator 90A and the second separator 90B in the left and right direction in a state where one arm C2 of the clothing C is drooping downward may be closer than the distance L2 between the first separator 90A and the second separator 90B in the left and right direction immediately after moving between the arm C2 and C3 and the body C1 of the clothing C.

By the mechanical force applied to the clothing C by the separator 90, the ring 22 of the clothing supporter 20 slides with respect to the holder 60, and the clothing supporter 20 and the clothing C can be tilted. As a result, one arm C2 of the clothing C may be separated from the body C1 and droop downward.

In this case, the pair of separators 90 may be located a space g3 between the front auxiliary body 33 and the rear auxiliary body 34 (see FIG. 3).

Accordingly, one arm C2 of the clothing C may be located a space g1 between the front steam body 31 and the rear steam body 32 g1 (see FIG. 3), and the body C1 and the other arm C3 may be located a space g3 between the front auxiliary body 33 and the rear auxiliary body 34.

Accordingly, in this state, when the steamer 30 elevates, the one arm C2 can be effectively refreshed without wrinkles by the steam sprayed from the front steam body 31 and the rear steam body 32. In addition, since the body C1 and the other arm C3 are located a space g3 between the front auxiliary body 33 and the rear auxiliary body 34, it can be prevented the risk that the body C1 and the other arm C3 may not be refreshed in a wrinkled state and wrinkles thereof becomes severe.

Figure 9A:
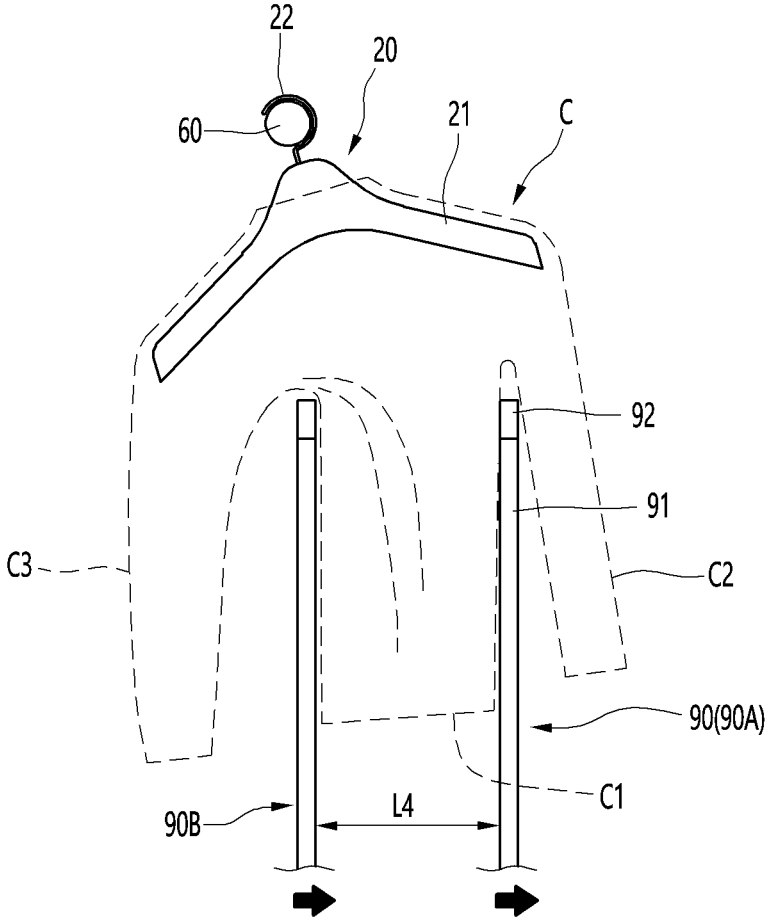
FIGS. 9A and 9B are views for explaining the operation of the separator for refreshing the other arm of the clothing.
Figure 9B:
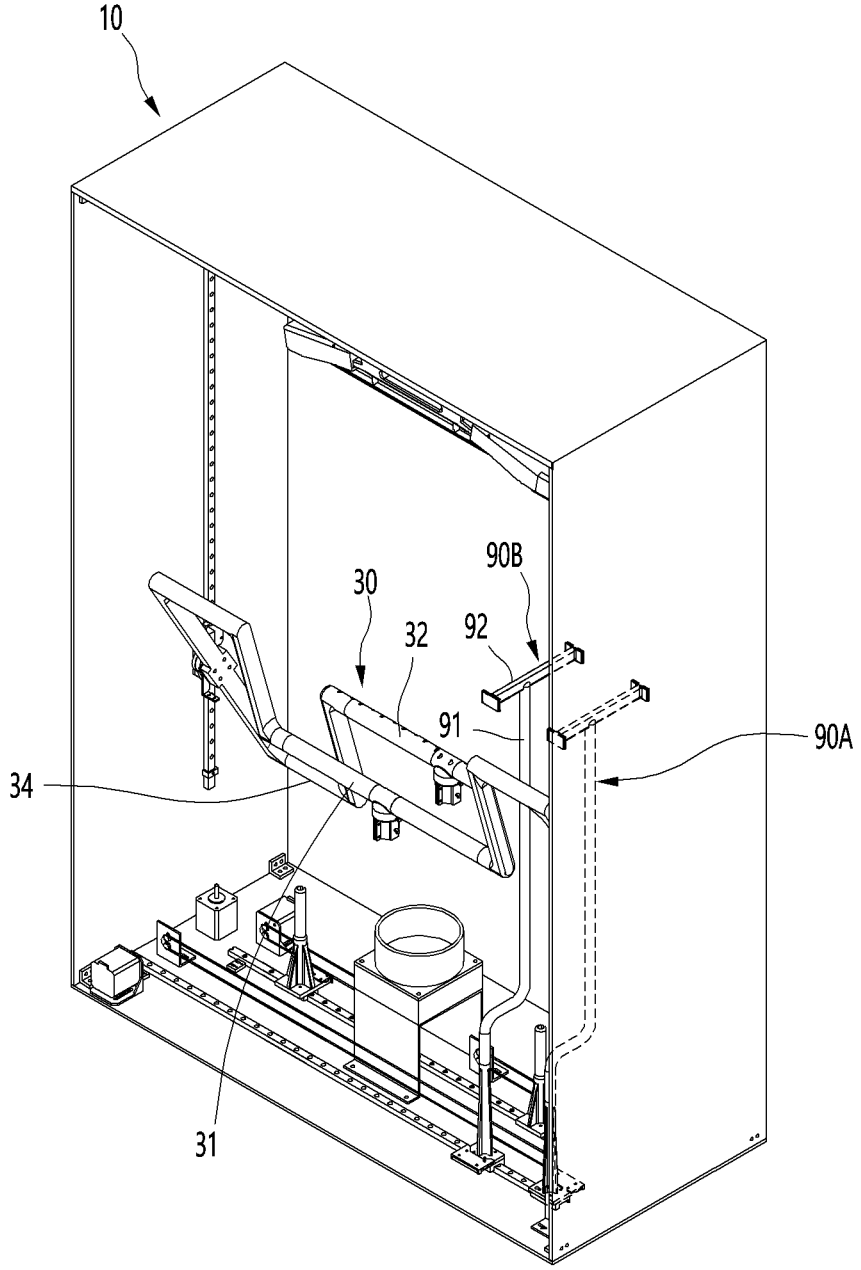

FIGS. 9A and 9B are views for explaining the operation of the separator for refreshing the other arm of the clothing. In more detail, FIG. 9A is a view for explaining the positional relationship between the separator and the clothing hung on the clothing supporter, and FIG. 9B is a view for explaining the positional relationship between the separator and the steamer.

The separator 90 may move in the other direction to separate the other arm C3 of the clothing C from the body C1 and droop it downward.

In more detail, the first separator 90A and the second separator 90B may each move in the other direction by a predetermined distance. In this case, the second separator 90B may move more than the first separator 90A. Accordingly, the distance L4 between the first separator 90A and the second separator 90B in the left and right direction in a state where the other arm C3 of the clothing C droops downward may be closer than the distance L2 between the first separator 90A and the second separator 90B in the left and right direction immediately after moving between the arm C2 and C3 and the body C1 of the clothing C.

By the mechanical force applied to the clothing C by the separator 90, the ring 22 of the clothing supporter 20 slides with respect to the holder 60, and the clothing supporter 20 and the clothing C can be tilted. Accordingly, the other arm C3 of the clothing C may be separated from the body C1 and may droop downward.

In this case, the pair of separators 90 may be located a space g2 between the front auxiliary body 33 and the rear auxiliary body 34 (see FIG. 3).

Accordingly, the other arm C3 of the clothing C may be located a space g1 between the front steam body 31 and the rear steam body 32 (see FIG. 3), and the body C1 and one arm C2 may be located a space g2 between the front auxiliary body 33 and the rear auxiliary body 34.

Accordingly, in this state, when the steamer 30 elevates, the other arm C3 can be effectively refreshed without wrinkles by the steam sprayed from the front steam body 31 and the rear steam body 32. In addition, since the body C1 and the other arm C2 are located a space g2 between the front auxiliary body 33 and the rear auxiliary body 34, it can be prevented the risk that the body C1 and the other arm C2 may not be refreshed in a wrinkled state and wrinkles thereof becomes severe.

Figure 10A:
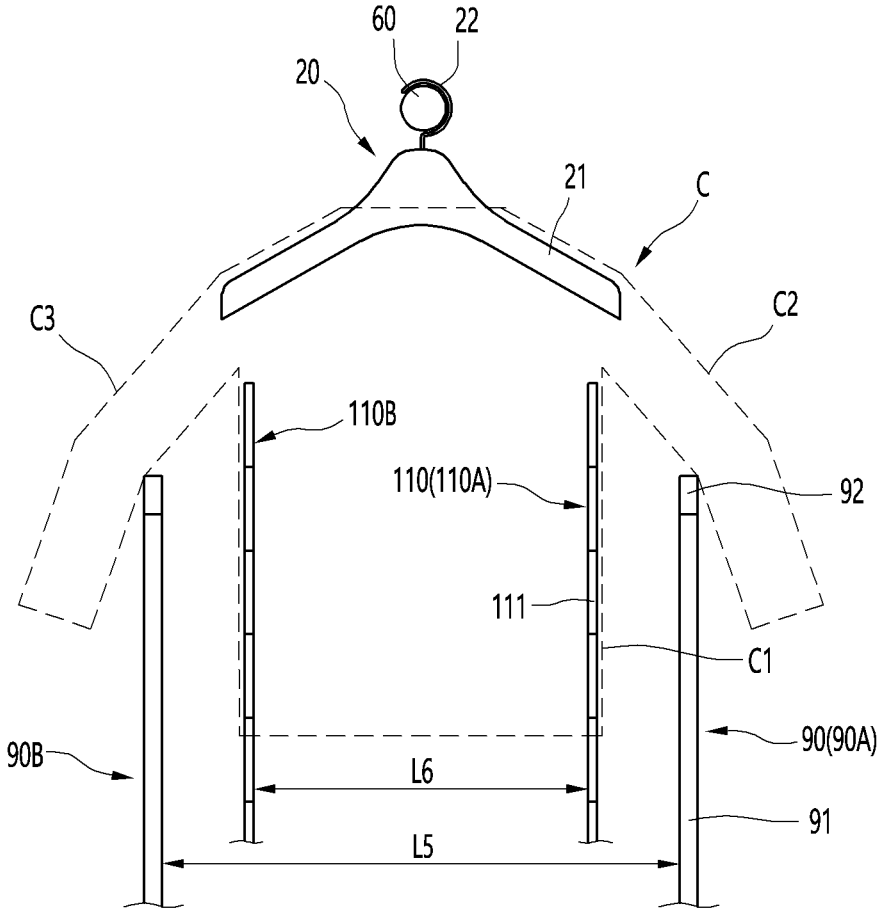
FIGS. 10A and 10B are views for explaining the operation of the separator and the spreader for refreshing the body of the clothing.
Figure 10B:
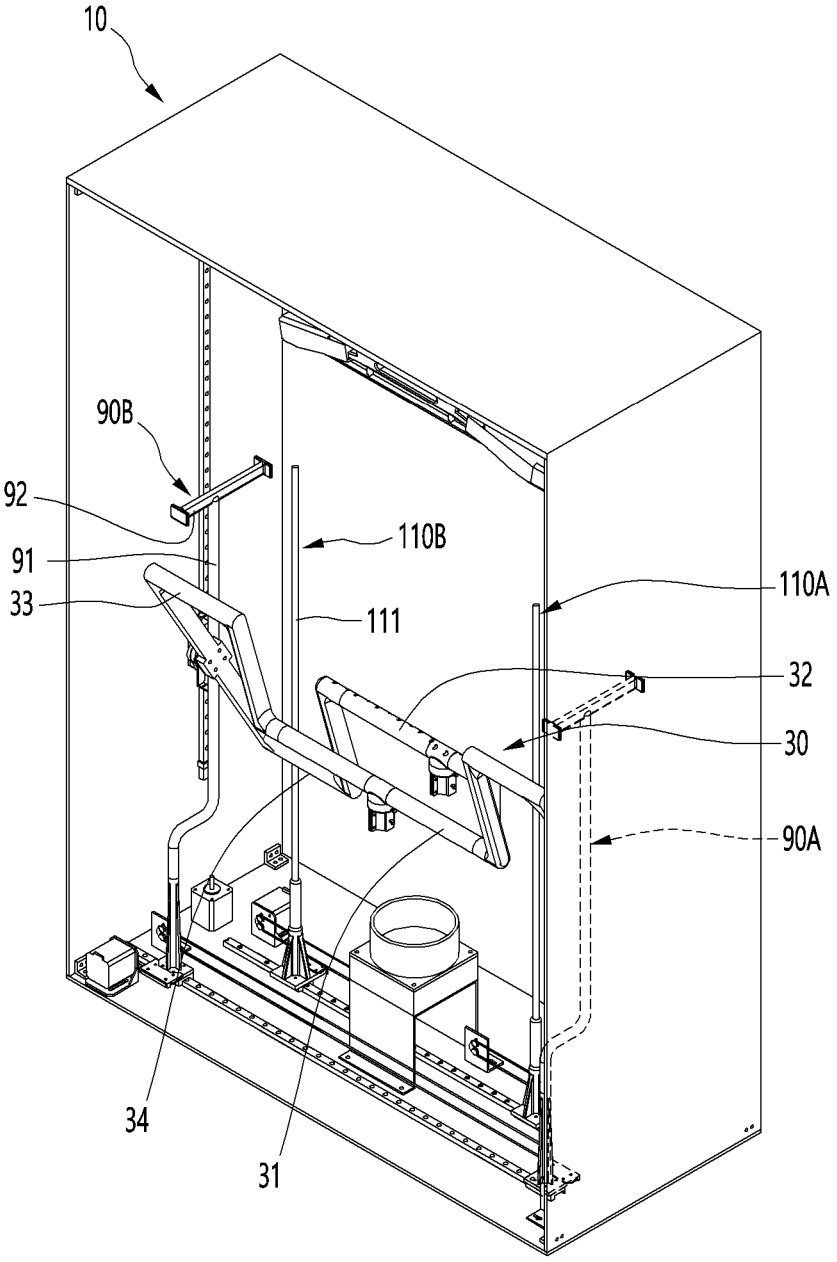

FIGS. 10A and 10B are views for explaining the operation of the separator and the spreader for refreshing the body of the clothing. In more detail, FIG. 10A is a view for explaining a positional relationship between clothing caught on a clothing supporter and a spreader and a separator, and FIG.

10B is a view for explaining a positional relationship between a separator, a spreader, and a steamer.

The pair of separators 90 may move in a direction away from each other to separate the arms C2 and C3 from the body C1 of the clothing C.

In more detail, the first separator 90A and the second separator 90B may move in a direction away from each other. The first separator 90A and the second separator 90B may move in opposite directions by the same distance from each other with respect to a virtual vertical plane passing through the holder 60. Accordingly, the clothing supporter 20 and the clothing C are not tilted, and the body C1 of the clothing C may droop downward.

Accordingly, in a state where both arms C2 and C3 of the clothing C are separated from the body C1, the distance L5 between the first separator 90A and the second separator 90B in the left and right direction may be greater than the distance L2 between the first separator 90A and the second separator 90B in the left and right direction immediately after moving between the body C1 and the arms C2 and C3 of the clothing C.

In this case, the first separator 90A may be located a space g2 between the one front auxiliary body 33 and the one rear auxiliary body 34 (see FIG. 3), and the second separator 90B may be located a space g3 between the other auxiliary body 33 and the other rear auxiliary body 34.

Accordingly, the body C1 of the clothing C may be located a space g1 between the front steam body 31 and the rear steam body 32, and both arms C2 and C3 may be located spaces g2 and g3 between the front auxiliary body 33 and the rear auxiliary body 34 located opposite to each other.

Accordingly, in this state, when the steamer 30 elevates, the body C1 of the clothing C can be effectively refreshed without wrinkles by the steam sprayed from the front steam body 31 and the rear steam body 32. In addition, since both arms C2 and C3 of the clothing C are located spaces g2 and g3 between the front auxiliary body 33 and the rear auxiliary body 34, it can be prevented the risk that both arms C2 and C3 of the clothing C may not be refreshed in a wrinkled state and wrinkles thereof becomes severe.

Meanwhile, in the pair of spreaders 110, the tension part 111 extends upward and can be inserted into the body C1 of the clothing C and moves in directions away from each other to tension the body C1 of the clothing C tautly.

In more detail, the first spreader 110A may press one side of the body C1 to the outside, and the second spreader 110B may press the other side of the body C1 to the outside.

In this case, the distance L6 between the first spreader 110A and the second spreader 110B in the left and right direction may be closer than the distance L5 between the first separator 90A and the second separator 90B in the left and right direction.

Since the body C1 of the clothing C is located a space g1 between the front steam body 31 and the rear steam body 32, the first spreader 110A and the second spreader 110B also may be located a space g1 between the front steam body 31 and the rear steam body 32.

The steamer 30 may elevate in a state where the body C1 of the clothing C is spread taut by the spreader and may spray steam. Accordingly, wrinkles on the body C1 of the clothing C may be more effectively removed.

Figure 11:
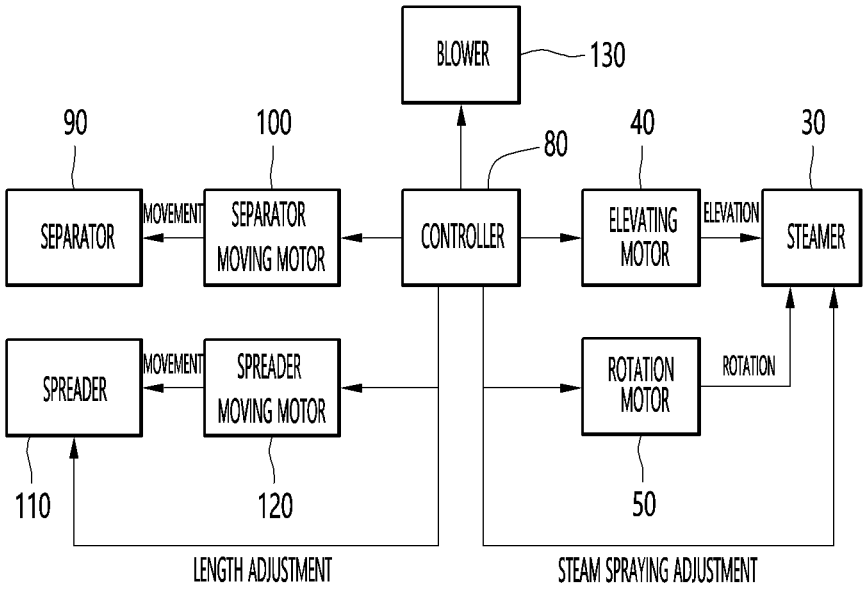
FIG. 11 is a control block diagram illustrating a clothing processing apparatus according to an embodiment of the present disclosure.

FIG. 11 is a control block diagram illustrating a clothing processing apparatus according to an embodiment of the present disclosure.

The controller 80 of the clothing processing apparatus according to the present embodiment may control the elevating motor 40, the rotation motor 50, the separator moving motor 100, and the spreader moving motor 120.

The controller 80 may adjust the steam injection of the steamer 30.

The controller 80 may control the elevating motor 40 to elevate the steamer 30. Also, the controller 80 may control the rotation motor 50 to rotate the steamer 30. The controller 80 may simultaneously control the elevating motor 40 and the rotation motor 50 to combine elevating and rotating operations of the steamer 30 to spray steam onto the clothing C in various ways.

The controller 80 may control the separator moving motor 100 to move the separator 90 in the left and right direction.

In more detail, the controller 80 may move the first separator 90A and the second separator 90B in a direction away from each other from the initial position, and the first separator 90A and the second separator 90B may move between the body C1 and arms C2 and C3 of the clothing C.

Thereafter, the controller 80 separates one arm C2 of the clothing C from the body C1 by moving the first separator 90A and the second separator 90B in one direction to droop downward.

Alternatively, the controller 80 separates the other arm C3 of the clothing C from the body C1 by moving the first separator 90A and the second separator 90B in the other direction to droop downward.

Alternatively, the controller 80 may separate the arms C2 and C3 of the clothing C from the body C1 by moving the first separator 90A and the second separator 90B away from each other.

Meanwhile, the controller 80 may adjust the length of the spreader 110. In more detail, the controller 80 may extend or reduce the length of the tension part 111 of the spreader 110 in the vertical direction.

The controller 80 may extend the first separator 90A and the second separator 90B to be inserted into the body C1 of the clothing C.

The controller 80 may control the spreader moving motor 120 to move the spreader 110 in the left and right direction.

The controller 80 may move the first spreader 110A and the second spreader 1106 away from each other in a state where the first spreader 110A and the second spreader 1106 are inserted into the body C1 of the clothing C. Accordingly, the body C1 of the clothing C may be tensioned tautly.

Meanwhile, the controller 80 may control the blower 130. In more detail, the controller 80 may control the on/off of the blowing fan 131. In a case where the blowing fan 131 is an inverter blowing fan, the controller 80 may control the rotation speed of the blowing fan 131.

The controller 80 may turn on the blower 130 so that the body C1 of the clothing C is opened by the wind.

Figure 12:
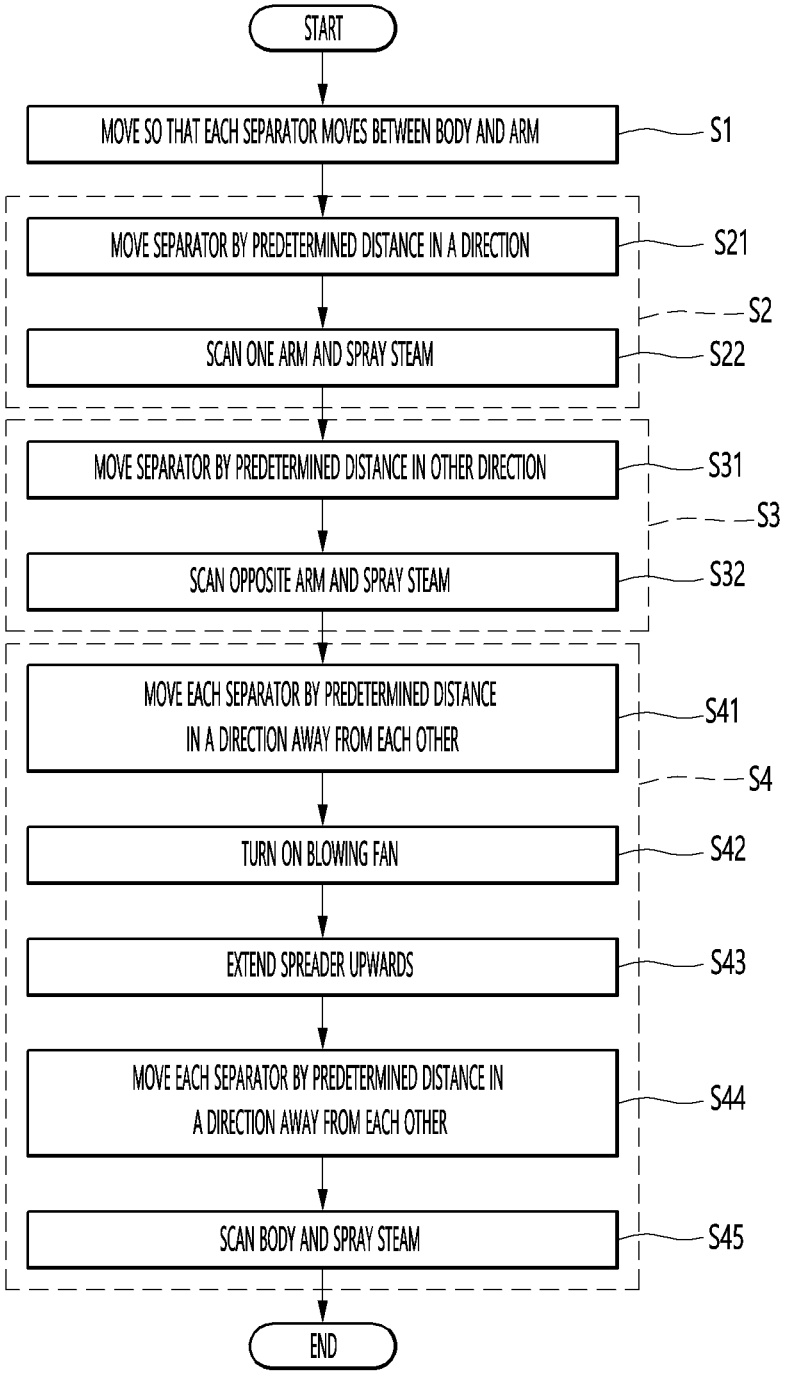
FIG. 12 is a flowchart illustrating an example of a method for controlling a clothing processing apparatus according to an embodiment of the present disclosure.

FIG. 12 is a flowchart illustrating an example of a method for controlling a clothing processing apparatus according to an embodiment of the present disclosure.

Hereinafter, a method for controlling the clothing processing apparatus according to the present embodiment will be described. The following control method may be performed in a state where the clothing supporter 20 on which the clothing C is hung is held on the holder 60.

The method for controlling the clothing processing apparatus according to the present embodiment may include a separation step S1, a first arm refreshing step S2, a second arm refreshing step S3, and a body refreshing step S4.

The separation step S1, the first arm refreshing step S2, the second arm refreshing step S3, and the body refreshing step S4 may be sequentially performed. This is because wrinkles may occur on the body C1 of the clothing C in the first arm refreshing step S2 and the second arm refreshing step S3.

In the separation step S1, the controller 80 controls the separator moving motor 100, and thus the first separator 90A and the second separator 90B can be moved in the opposite direction so that the first separator 90A and the second separator 90B, which were in the initial positions, are moved between the body C1 and the arm C2 and C3 of the clothing C. In this case, the first separator 90A can be moved between the body C1 and one of the arms C2 of the clothing C, and the second separator 90B can be moved between the body C1 and the other arm C3 of the clothing C.

The first arm refreshing step S2 may include a first arm alignment step S21 and a first arm scanning step S22.

In the first arm alignment step S21, the controller 80 may control each separator moving motor 100 to move the first separator 90A and the second separator 90B in one direction. In this case, one arm C2 of the clothing C may be separated from the body C1 to droop downward.

The first arm scan step S22 may be performed after the first arm alignment step S21. In the first arm scan step S22, the controller 80 may control the elevating motor 40 to elevate the steamer 30 and may spray steam from the steamer 30. Accordingly, the steamer 30 may refresh by scanning the one arm C2 which droops downward.

The second arm refreshing step S3 may include a second arm alignment step S31 and a second arm scanning step S32.

In the second arm alignment step S31, the controller 80 may control each separator moving motor 100 to move the first separator 90A and the second separator 90B in other directions. In this case, the other arm C3 of the clothing C may be separated from the body C1 to droop downward.

The second arm scanning step S32 may be performed after the second arm alignment step S31. In the second arm scan step S32, the controller 80 may control the elevating motor 40 to elevate the steamer 30 and may spray steam from the steamer 30. Accordingly, the steamer 30 may refresh while scanning the other arm C3 which droops downward.

The body refreshing step S4 may include a body alignment step S41, a blowing step S42, an insertion step S43, a tension step S44, and a body scanning step S45.

In the body alignment step S41, the controller 80 may control the separator moving motor 100 to move the first separator 90A and the second separator 90B in a direction away from each other. In this case, the body C1 of the clothing C may be separated from the arms C2 and C3 to droop downward.

The blowing step S42 may be performed after the body alignment step S41. In the blowing step S42, the controller 80 may turn on the blowing fan 131. In this case, the wind generated by the blowing fan 131 may be directed upward and the body C1 of the clothing C may be opened by the wind.

The insertion step S43 may be performed simultaneously with the blowing step S42 or may be performed after the blowing step S42. The controller 80 may extend the spreader 110 in a state where the blowing fan 131 is turned on and insert it into the body C1 of the clothing C. When the extension of the spreader 110 is completed, the controller 80 may turn off the blowing fan 131.

The tension step S44 may be performed after the insertion step S43. In the tension step S44, the controller 80 may control the spreader moving motor 120 to move the pair of spreaders 110 by a predetermined distance in a direction away from each other. Accordingly, the body C1 of the clothing C may be tensioned tautly.

Also, the controller 80 may stop the movement of the spreader 110 when the load applied to the spreader moving motor 120 is greater than or equal to a set value. Accordingly, it is possible to adjust the appropriate movement distance of the spreader 110 according to the size of the clothing C.

The body scanning step S45 may be performed after the tension step S44. In the body scanning step S45, the controller 80 may control the elevating motor 40 to elevate the steamer 30 and may spray steam from the steamer 30. Accordingly, the steamer 30 may refresh the body C1 while scanning the tautly tensioned body C1.

According to a preferred embodiment of the present disclosure, in a state where the body of the clothing is tensioned tautly by the spreader, the steamer may spray steam while elevating. Accordingly, the clothing can be refreshed without wrinkles on the body.

In addition, since the spreader moves within the body of the clothing to tension the clothing, the clothing can be spread tauter.

In addition, since the spreader moves within the body of the clothing to tension the clothing, the clothing processing apparatus can be more compact than the conventional method of tensioning the clothing from the outside of the clothing by a press. Therefore, there is an advantage suitable for using the clothing processing apparatus for home use.

In addition, since the tension part of the spreader has a multi-stage structure, the length thereof can be easily changed.

In addition, since the movement of the spreader in the left and right direction is guided by the spreader guide rail, the operation reliability of the spreader may be improved.

In addition, since the body of the clothing is opened by the air blown by the blower, the spreader can be easily inserted into the body.

In addition, since the scan directions of the body and arms of the clothing are the same, the same single steamer can be used. Accordingly, the configuration of the clothing processing apparatus can be simplified.

In addition, in a state where the arm and body of the clothing are separated by the separator to droop downward, the steamer may spray steam while elevating. In this way, the clothing can be refreshed without wrinkles on the arms.

In addition, since the arm is spread by drooping downward, the clothing processing apparatus can be compact compared to the conventional method in which the arm is spread by directly applying a mechanical force to the arm. Therefore, there is an advantage suitable for using the clothing processing apparatus for home use.

In addition, since the alignment and scanning of the body and arms of the clothing are automatically performed, there is an advantage in that the user's convenience is increased.

What is claimed is:

1. A clothing processing apparatus comprising:

a cabinet having a receiving space formed therein, in which clothing is received;

a holder configured to be located in the receiving space to hold a clothing supporter configured to support the clothing;

a steamer configured to spray steam toward the clothing while the steamer moves inside the receiving space in a vertical direction;

an elevating motor configured to provide an elevating power of the steamer;

a spreader configured to move in a left and right direction to move into a body of the clothing and apply a mechanical force so as to spread the body of the clothing;

a spreader moving motor configured to move the spreader in the left and right direction;

a separator configured to move in the left and right direction and to move between the body and arms of the clothing to separate the body and the arms of the clothing; and a separator moving motor configured to move the separator in the left and right direction.

2. The clothing processing apparatus of claim 1, wherein the spreader includes:

a moving body configured to move in the left and right direction by the spreader moving motor; and a tension part configured to protrude upward from the moving body and to move into the body of the clothing.

3. The clothing processing apparatus of claim 2, wherein the tension part has a multi-stage structure in which a length is variable.

4. The clothing processing apparatus of claim 2, further comprising a spreader guide rail configured to be disposed on an inner bottom surface of the cabinet long in the left and right direction to guide the movement of the moving body in the left and right direction.

5. The clothing processing apparatus of claim 4, wherein the moving body includes:

a main body to which the tension part is connected, and a guide block located below the main body and having a guide groove into which the spreader guide rail is fitted formed therein.

6. The clothing processing apparatus of claim 1, further comprising:

a rotation pulley configured to be connected to the spreader moving motor;

a support pulley configured to be spaced apart from the rotation pulley; and a belt configured to be connected to the rotation pulley and the support pulley to form a closed curve, wherein a belt holder holding the belt is provided in the spreader.

7. The clothing processing apparatus of claim 1, further comprising:

a spreader guide rail configured to be disposed long in the left and right direction on an inner bottom surface of the cabinet to guide movement of the spreader in the left and right direction, and a separator guide rail configured to be spaced from the spreader guide rail in a front and rear direction, to be disposed long in a direction parallel to the spreader guide rail, and to guide the movement of the separator in the left and right direction.

8. The clothing processing apparatus of claim 7, wherein a length of the spreader guide rail is shorter than a length of the separator guide rail.

9. The clothing processing apparatus of claim 1, further comprising a blower configured to be disposed inside the cabinet and to blow air into the body of the clothing from a lower side of the clothing.

10. The clothing processing apparatus of claim 9, wherein the blower includes:

a blowing fan;

an air guide configured to guide the air blown by the blowing fan into the body of the clothing; and a blowing fan support part configured to be installed on an inner bottom surface of the cabinet and to support the blowing fan.

11. The clothing processing apparatus of claim 10, further comprising a spreader guide rail configured to be disposed long in the left and right direction on the inner bottom surface of the cabinet, to pass through an inner portion of the blower fan support, and to guide the movement of the spreader in the left and right direction.

12. The clothing processing apparatus of claim 9, wherein a pair of the spreaders positioned opposite to each other with respect to the blower are provided.

* * * * *